US009885004B2

(12) United States Patent
Deckman et al.

(10) Patent No.: US 9,885,004 B2
(45) Date of Patent: Feb. 6, 2018

(54) METHOD FOR IMPROVING ENGINE FUEL EFFICIENCY

(71) Applicant: ExxonMobil Research and Engineering Company, Annandale, NJ (US)

(72) Inventors: Douglas E. Deckman, Mullica Hill, NJ (US); Dennis A. Gaal, Glassboro, NJ (US); Erik Herz, Conroe, TX (US); Mrugesh N. Patel, The Woodlands, TX (US)

(73) Assignee: EXXONMOBIL RESEARCH AND ENGINEERING COMPANY, Annandale, NJ (US)

( * ) Notice: Subject to any disclaimer, the term of this patent is extended or adjusted under 35 U.S.C. 154(b) by 0 days.

(21) Appl. No.: 15/421,707

(22) Filed: Feb. 1, 2017

(65) Prior Publication Data

US 2017/0211007 A1 Jul. 27, 2017

Related U.S. Application Data

(63) Continuation-in-part of application No. 14/219,284, filed on Mar. 19, 2014, now abandoned.
(Continued)

(51) Int. Cl.
*C10M 161/00* (2006.01)
*C10M 145/28* (2006.01)
(Continued)

(52) U.S. Cl.
CPC ..... *C10M 161/00* (2013.01); *C10M 129/68* (2013.01); *C10M 129/76* (2013.01);
(Continued)

(58) Field of Classification Search
CPC ..... C10M 129/68; C10M 129/76; C10M 141/06; C10M 141/12; C10M 161/00;
(Continued)

(56) References Cited

U.S. PATENT DOCUMENTS 1,815,022 A 7/1931 Davis
2,015,748 A 10/1935 Frolich
(Continued)

FOREIGN PATENT DOCUMENTS

CA 1094044 1/1981
EP 464546 A1 8/1992
(Continued)

OTHER PUBLICATIONS

Bardasz, Ewa A. et al., "Additives for Crankcase Lubricant Applications," Lubricant Additives Chemistry and Applications, 2009, Chapter 19.
(Continued)

*Primary Examiner* — James Goloboy
(74) *Attorney, Agent, or Firm* — Robert A. Migliorini

(57) ABSTRACT

A method for improving fuel efficiency and reducing frictional properties while maintaining or improving deposit control, in an engine lubricated with a lubricating oil by using as the lubricating oil a formulated oil. The formulated oil has a composition including from 75 to 95 wt % of lubricating oil base stock including a Group I base stock or a combination of a Group III, Group IV and Group V base stock including from 30 to 35 wt % Group III, 45 to 55 wt % Group IV and 0 to 5 wt % Group V and a friction modifier mixture comprising a polymeric ethoxylated fatty acid ester at from 0.1 to 1.0 wt. % and a mixed glyceride ester at from 0.1 to 1.0 wt. % of the formulated oil. The lubricating engine oils are useful in internal combustion engines including direct injection, gasoline and diesel engines.

23 Claims, 13 Drawing Sheets

| Name | Comparative Example 1 | Comparative Example 2 | Comparative Example 3 |
|---|---|---|---|
| Base Stock – Group IV | 49.71 | 50.38 | 50.23 |
| Base Stock – Group III | 30 | 30 | 30 |
| Base Stock – Group V | 5 | 5 | 5 |
| Mixed Glyceride Ester | 0.52 | | |
| Molybdenum-containing Complex | 0.15 | | 0.15 |
| Remainder of Formulation | 14.62 | 14.62 | 14.62 |
| Total | 100 | 100 | 100 |
| | | | |
| KV@100C, ASTM D445, mm2/s | 8.66 | 8.70 | 8.76 |
| HTHS@150C, ASTM D4683, cP | 2.6 | 2.6 | 2.6 |
| Calcium, wt.% | 0.110 | 0.110 | 0.110 |
| Magnesium, wt.% | 0.077 | 0.077 | 0.077 |
| Boron, wt.% | 0.010 | 0.010 | 0.010 |
| Phosphorus, wt.% | 0.065 | 0.065 | 0.065 |
| Zinc, wt.% | 0.072 | 0.072 | 0.072 |
| Molybdenum, wt.% | 0.008 | 0.000 | 0.008 |
| Sulfated Ash, wt.% | 0.89 | 0.89 | 0.89 |
| TBN 2896, mg KOH/g | 9.05 | 9.05 | 9.05 |
| TBN 4739, mg KOH/g | 7.21 | 7.21 | 7.21 |
| Integrated MTM Friction@140C | 0.299 | 0.280 | 0.283 |
| TEOST 33C, mg | 18 | 52 | 57 |
| Kinematic Viscosity 100C, mm2/s | 8.7 | 8.6 | 8.7 |

Related U.S. Application Data

(60) Provisional application No. 61/920,169, filed on Dec. 23, 2013.

(51) Int. Cl.

| | |
|---|---|
| ***C10M 129/68*** | (2006.01) |
| ***C10M 141/06*** | (2006.01) |
| ***C10M 141/12*** | (2006.01) |
| ***C10M 129/76*** | (2006.01) |

(52) U.S. Cl.

CPC ..... *C10M 141/06* (2013.01); *C10M 141/12* (2013.01); *C10M 2203/1006* (2013.01); *C10M 2203/1025* (2013.01); *C10M 2205/02* (2013.01); *C10M 2205/0285* (2013.01); *C10M 2207/021* (2013.01); *C10M 2207/026* (2013.01); *C10M 2207/04* (2013.01); *C10M 2207/141* (2013.01); *C10M 2207/144* (2013.01); *C10M 2207/26* (2013.01); *C10M 2207/262* (2013.01); *C10M 2207/28* (2013.01); *C10M 2207/283* (2013.01); *C10M 2207/289* (2013.01); *C10M 2209/062* (2013.01); *C10M 2209/084* (2013.01); *C10M 2209/103* (2013.01); *C10M 2209/104* (2013.01); *C10M 2209/109* (2013.01); *C10M 2215/064* (2013.01); *C10M 2215/082* (2013.01); *C10M 2215/26* (2013.01); *C10M 2215/28* (2013.01); *C10M 2215/30* (2013.01); *C10M 2219/044* (2013.01); *C10M 2219/046* (2013.01); *C10M 2219/068* (2013.01); *C10M 2223/045* (2013.01); *C10M 2229/02* (2013.01); *C10N 2210/02* (2013.01); *C10N 2210/06* (2013.01); *C10N 2230/02* (2013.01); *C10N 2230/04* (2013.01); *C10N 2230/06* (2013.01); *C10N 2230/10* (2013.01); *C10N 2230/12* (2013.01); *C10N 2230/14* (2013.01); *C10N 2230/18* (2013.01); *C10N 2230/36* (2013.01); *C10N 2230/42* (2013.01); *C10N 2230/45* (2013.01); *C10N 2230/54* (2013.01); *C10N 2240/10* (2013.01); *C10N 2260/14* (2013.01)

(58) Field of Classification Search

CPC ..... C10M 2203/1025; C10M 2205/02; C10M 2205/0285; C10M 2207/021; C10M 2207/026; C10M 2207/04; C10M 2207/141; C10M 2207/144; C10M 2207/26; C10M 2207/262; C10M 2207/28; C10M 2207/283; C10M 2207/289; C10M 2209/02; C10M 2209/084; C10M 2209/103; C10M 2209/104; C10M 2209/109; C10M 2215/064; C10M 2215/082; C10M 2215/26; C10M 2215/28; C10M 2205/30; C10M 2219/044; C10M 2219/046; C10M 2219/068; C10M 2223/045; C10N 2210/02; C10N 2210/06; C10N 2230/02; C10N 2230/06; C10N 2230/10; C10N 2230/12; C10N 2230/14; C10N 2230/18; C10N 2230/36; C10N 2230/42; C10N 2230/45; C10N 2230/54; C10N 2240/10; C10N 2260/14

See application file for complete search history.

(56) References Cited

U.S. PATENT DOCUMENTS

| | | | |
|---|---|---|---|
| 2,191,498 | A | 2/1940 | Reiff |
| 2,387,501 | A | 10/1945 | Dietrich |
| 2,655,479 | A | 10/1953 | Munday et al. |
| 2,666,746 | A | 1/1954 | Munday et al. |
| 2,721,877 | A | 10/1955 | Popkin et al. |
| 2,721,878 | A | 10/1955 | Popkin |
| 2,817,693 | A | 12/1957 | Koome et al. |
| 3,036,003 | A | 5/1962 | Verdol |
| 3,087,936 | A | 4/1963 | LeSuer |
| 3,172,892 | A | 3/1965 | LeSue et al. |
| 3,200,107 | A | 8/1965 | LeSuer |
| 3,215,707 | A | 11/1965 | Rense |
| 3,219,666 | A | 11/1965 | Norman et al. |
| 3,250,715 | A | 5/1966 | Wyman |
| 3,254,025 | A | 5/1966 | LeSuer |
| 3,272,746 | A | 9/1966 | LeSuer et al. |
| 3,275,554 | A | 9/1966 | Wagenaar |
| 3,316,177 | A | 4/1967 | Dorer, Jr. |
| 3,322,670 | A | 5/1967 | Burt et al. |
| 3,329,658 | A | 7/1967 | Fields |
| 3,341,542 | A | 9/1967 | LeSuer et al. |
| 3,382,291 | A | 5/1968 | Brennan |
| 3,413,347 | A | 11/1968 | Worrel |
| 3,438,757 | A | 4/1969 | Honnen et al. |
| 3,444,170 | A | 5/1969 | Norman et al. |
| 3,449,250 | A | 6/1969 | Fields |
| 3,454,555 | A | 7/1969 | van der Voort et al. |
| 3,454,607 | A | 7/1969 | LeSuer et al. |
| 3,519,565 | A | 7/1970 | Coleman |
| 3,541,012 | A | 11/1970 | Stuebe |
| 3,565,804 | A | 2/1971 | Honnen et al. |
| 3,595,791 | A | 7/1971 | Cohen |
| 3,630,904 | A | 12/1971 | Musser et al. |
| 3,632,511 | A | 1/1972 | Liao |
| 3,652,616 | A | 3/1972 | Watson et al. |
| 3,666,730 | A | 5/1972 | Coleman |
| 3,687,849 | A | 8/1972 | Abbott |
| 3,697,574 | A | 10/1972 | Piasek et al. |
| 3,702,300 | A | 11/1972 | Coleman |
| 3,703,536 | A | 11/1972 | Piasek et al. |
| 3,704,308 | A | 11/1972 | Piasek et al. |
| 3,725,277 | A | 4/1973 | Worrell |
| 3,725,480 | A | 4/1973 | Traise et al. |
| 3,726,882 | A | 4/1973 | Traise et al. |
| 3,742,082 | A | 6/1973 | Brennan |
| 3,751,365 | A | 8/1973 | Piasek et al. |
| 3,755,433 | A | 8/1973 | Miller et al. |
| 3,756,953 | A | 9/1973 | Piasek et al. |
| 3,769,363 | A | 10/1973 | Brennan |
| 3,787,374 | A | 1/1974 | Adams |
| 3,798,165 | A | 3/1974 | Piasek et al. |
| 3,803,039 | A | 4/1974 | Piasek et al. |
| 3,822,209 | A | 7/1974 | Knapp et al. |
| 3,876,720 | A | 4/1975 | Heilman et al. |
| 3,948,800 | A | 4/1976 | Meinhardt |
| 4,100,082 | A | 7/1978 | Clason et al. |
| 4,149,178 | A | 4/1979 | Esles |
| 4,218,330 | A | 8/1980 | Shubkin |
| 4,234,435 | A | 11/1980 | Meinhardt et al. |
| 4,239,930 | A | 12/1980 | Allphin et al. |
| 4,266,945 | A | 5/1981 | Kam |
| 4,367,352 | A | 1/1983 | Watts, Jr. et al. |
| 4,413,156 | A | 11/1983 | Watts, Jr. et al. |
| 4,426,305 | A | 1/1984 | Malec |
| 4,434,408 | A | 2/1984 | Baba et al. |
| 4,454,059 | A | 6/1984 | Pindar et al. |
| 4,529,526 | A | 7/1985 | Inoue et al. |
| 4,594,172 | A | 6/1986 | Sie |
| 4,767,551 | A | 8/1988 | Hunt et al. |
| 4,798,684 | A | 1/1989 | Salomon |
| 4,827,064 | A | 5/1989 | Wu |
| 4,827,073 | A | 5/1989 | Wu |
| 4,897,178 | A | 1/1990 | Best et al. |
| 4,904,401 | A | 2/1990 | Ripple et al. |
| 4,910,355 | A | 3/1990 | Shubkin et al. |

(56) References Cited

U.S. PATENT DOCUMENTS

| | | | | |
|---|---|---|---|---|
| 4,921,594 | A | 5/1990 | Miller | |
| 4,921,624 | A | 5/1990 | Kammann, Jr. | |
| 4,943,672 | A | 7/1990 | Hamner et al. | |
| 4,956,122 | A | 9/1990 | Watts et al. | |
| 4,975,177 | A | 12/1990 | Garwood et al. | |
| 5,068,487 | A | 11/1991 | Theriot | |
| 5,075,269 | A | 12/1991 | Degnan et al. | |
| 5,084,197 | A | 1/1992 | Galic et al. | |
| 5,114,603 | A | 5/1992 | Kennedy et al. | |
| 5,705,458 | A | 1/1998 | Roby et al. | |
| 6,034,039 | A | 3/2000 | Gomes et al. | |
| 6,080,301 | A | 6/2000 | Berlowitz et al. | |
| 6,090,989 | A | 7/2000 | Trewella et al. | |
| 6,165,949 | A | 12/2000 | Berlowitz et al. | |
| 7,704,930 | B2 | 4/2010 | Deckman et al. | |
| 8,048,833 | B2 | 11/2011 | Habeeb et al. | |
| 9,018,149 | B2 | 4/2015 | Farng et al. | |
| 9,228,152 | B2 | 1/2016 | Thompson et al. | |
| 2004/0242435 | A1 | 12/2004 | Nishimura et al. | |
| 2005/0070449 | A1 | 3/2005 | Roby et al. | |
| 2006/0172896 | A1* | 8/2006 | Conroy | C10M 169/048 508/110 |
| 2006/0211581 | A1* | 9/2006 | Bullock, Jr. | C10G 50/02 508/110 |
| 2007/0111904 | A1* | 5/2007 | Van Dam | C10M 163/00 508/273 |
| 2007/0265176 | A1 | 11/2007 | Poirier et al. | |
| 2008/0176778 | A1 | 7/2008 | Seemeyer et al. | |
| 2008/0261838 | A1 | 10/2008 | Karol et al. | |
| 2008/0280795 | A1 | 11/2008 | Fujitsu et al. | |
| 2009/0003742 | A1 | 1/2009 | Nakatani et al. | |
| 2010/0190669 | A1 | 7/2010 | Davies et al. | |
| 2010/0190670 | A1 | 7/2010 | Sekiguchi et al. | |
| 2010/0197536 | A1 | 8/2010 | Mosier et al. | |
| 2011/0294707 | A1 | 2/2011 | Abraham | |
| 2011/0287990 | A1 | 11/2011 | Farng et al. | |
| 2013/0143782 | A1 | 6/2013 | Baillargeon | |
| 2013/0274158 | A1 | 10/2013 | Woodward et al. | |
| 2013/0274161 | A1 | 10/2013 | Woodward et al. | |
| 2014/0274841 | A1 | 9/2014 | Mayernick et al. | |
| 2015/0344810 | A1 | 12/2015 | Strong et al. | |
| 2015/0344811 | A1 | 12/2015 | Strong et al. | |

FOREIGN PATENT DOCUMENTS

| | | | |
|---|---|---|---|
| EP | 464547 | A1 | 8/1992 |
| EP | 471071 | B1 | 8/1995 |
| EP | 1757673 | A1 | 2/2007 |
| EP | 2248878 | A1 | 11/2010 |
| GB | 1429494 | | 4/1972 |
| GB | 1350257 | | 4/1974 |
| GB | 1390359 | | 4/1975 |
| GB | 1440230 | | 6/1976 |
| WO | 2003064570 | A1 | 8/2003 |
| WO | 2015193395 | A1 | 12/2015 |

OTHER PUBLICATIONS

Kim, Changsoo et al., "Development of the Ball Rust Test-A Laboratory Test Replacing the Sequence IID Engine Test," SAE Technical Paper Series, 1997, International Fall Fuels & Lubricants Meeting & Exposition, Tulsa, Oklahoma.

Kuo, Cheng C. et al., "The Effects of Oil Additives in the Ball Rust Test," SAE Technical Paper Series, 1997, International Fall Fuels & Lubricants Meeting & Exposition, Tulsa, Oklahoma.

Beyer, J. "Grode Lubricants . . . Leading the way naturally," Tribology and Lubrication Technology, 2014, vol. 70, No. 11, Society of Tribologists and Lubrication Engineers, Park Ridge, Illinois.

Beyer, J. "Leading the way naturally," Tribology and Lubrication Technology, 2013, vol. 69, No. 11, Society of Tribologists and Lubrication Engineers, Park Ridge, Illinois.

"Product News: Fine tune your FM," Lubes-n-Greases, 2012, vol. 18, No. 12, LNG Publishing Company, Inc., Falls Church, Virginia, Abstract.

Swaminathan, S. "Croda Lubricants: Leading the way naturally," Tribology and Lubrication Technology, 2011, vol. 67, No. 11, Society of Tribologists and Lubrication Engineers, Park Ridge, Illinois.

The International Search Report and Written Opinion of PCT/US2014/032476 dated Aug. 12, 2014.

* cited by examiner

Fig. 1

| Name | Comparative Example 1 | Comparative Example 2 | Comparative Example 3 |
|---|---|---|---|
| Base Stock – Group IV | 49.71 | 50.38 | 50.23 |
| Base Stock – Group III | 30 | 30 | 30 |
| Base Stock – Group V | 5 | 5 | 5 |
| Mixed Glyceride Ester | 0.52 | | |
| Molybdenum-containing Complex | 0.15 | | 0.15 |
| Remainder of Formulation | 14.62 | 14.62 | 14.62 |
| Total | 100 | 100 | 100 |
| | | | |
| KV@100C, ASTM D445, mm2/s | 8.66 | 8.70 | 8.76 |
| HTHS@150C, ASTM D4683, cP | 2.6 | 2.6 | 2.6 |
| Calcium, wt.% | 0.110 | 0.110 | 0.110 |
| Magnesium, wt.% | 0.077 | 0.077 | 0.077 |
| Boron, wt.% | 0.010 | 0.010 | 0.010 |
| Phosphorus, wt.% | 0.065 | 0.065 | 0.065 |
| Zinc, wt.% | 0.072 | 0.072 | 0.072 |
| Molybdenum, wt.% | 0.008 | 0.000 | 0.008 |
| Sulfated Ash, wt.% | 0.89 | 0.89 | 0.89 |
| TBN 2896, mg KOH/g | 9.05 | 9.05 | 9.05 |
| TBN 4739, mg KOH/g | 7.21 | 7.21 | 7.21 |
| Integrated MTM Friction@140C | 0.299 | 0.280 | 0.283 |
| TEOST 33C, mg | 18 | 52 | 57 |
| Kinematic Viscosity 100C, mm2/s | 8.7 | 8.6 | 8.7 |

Fig. 4

| Name | Comparative Example 4 | Comparative Example 5 | Inventive Example 1 |
|---|---|---|---|
| Base Stock – Group IV | 47.09 | 47.09 | 46.89 |
| Base Stock – Group III | 30 | 30 | 30 |
| Base Stock – Group V | 5 | 5 | 5 |
| Ethoxylated Fatty Ester | | 0.52 | 0.52 |
| Mixed Glyceride Ester | 0.52 | | 0.2 |
| Remainder of Formulation | 17.39 | 17.39 | 17.39 |
| Total | 100 | 100 | 100 |
| | | | |
| KV@100C, ASTM D445, mm2/s | 8.66 | 8.70 | 8.76 |
| HTHS@150C, ASTM D4683, cP | 2.6 | 2.6 | 2.6 |
| Calcium, wt.% | 0.110 | 0.110 | 0.110 |
| Magnesium, wt.% | 0.077 | 0.077 | 0.077 |
| Boron, wt.% | 0.010 | 0.010 | 0.010 |
| Phosphorus, wt.% | 0.065 | 0.065 | 0.065 |
| Zinc, wt.% | 0.072 | 0.072 | 0.072 |
| Molybdenum, wt.% | 0.008 | 0.000 | 0.008 |
| Sulfated Ash, wt.% | 0.89 | 0.89 | 0.89 |
| TBN 2896, mg KOH/g | 9.05 | 9.05 | 9.05 |
| TBN 4739, mg KOH/g | 7.21 | 7.21 | 7.21 |
| Integrated MTM Friction@140C | 0.216 | 0.167 | 0.178 |
| TEOST 33C, mg | 28 | 43 | 30 |
| Kinematic Viscosity 100C, mm2/s | 8.6 | 8.8 | 8.8 |

Fig. 5

| Name | Comparative Example 4 | Comparative Example 5 | Inventive Example 1 | Inventive Example 2 | Inventive Example 3 |
|---|---|---|---|---|---|
| Base Stock – Group IV | 47.09 | 47.09 | 46.89 | 47.41 | 47.26 |
| Base Stock – Group III | 30 | 30 | 30 | 30 | 30 |
| Base Stock – Group V | 5 | 5 | 5 | 5 | 5 |
| Ethoxylated Fatty Ester | | 0.52 | 0.52 | 0.1 | 0.25 |
| Mixed Glyceride Ester | 0.52 | | 0.2 | 0.1 | 0.1 |
| Rest of Formulation (constant) | 17.39 | 17.39 | 17.39 | 17.39 | 17.39 |
| Total | 100 | 100 | 100 | 100 | 100 |
| Calcium, wt.% | 0.235 | 0.235 | 0.235 | 0.235 | 0.235 |
| Magnesium, wt.% | 0.000 | 0.000 | 0.000 | 0.000 | 0.000 |
| Boron, wt.% | 0.010 | 0.010 | 0.010 | 0.010 | 0.010 |
| Phosphorus, wt.% | 0.065 | 0.065 | 0.065 | 0.065 | 0.065 |
| Zinc, wt.% | 0.072 | 0.072 | 0.072 | 0.072 | 0.072 |
| Molybdenum, wt.% | 0.008 | 0.008 | 0.008 | 0.008 | 0.008 |
| Sulfated Ash, wt.% | 0.95 | 0.95 | 0.95 | 0.95 | 0.95 |
| TBN 2896, mg KOH/g | 9.2 | 9.2 | 9.2 | 9.2 | 9.2 |
| TBN 4739, mg KOH/g | 7.3 | 7.3 | 7.3 | 7.3 | 7.3 |
| MTM Integrated Area 140°C | 0.216 | 0.167 | 0.178 | 0.173 | 0.152 |
| TEOST 33C Total Deposits, mg | 28 | 43 | 30 | 32 | 40 |
| Kinematic Viscosity 100C, mm2/s | 8.6 | 8.8 | 8.8 | 8.8 | 8.8 |

Fig. 5 (Cont.)

| Name | Inventive Example 5 | Inventive Example 6 | Inventive Example 7 | Inventive Example 8 | Inventive Example 9 | Inventive Example 10 |
|---|---|---|---|---|---|---|
| Base Stock – Group IV | 47.01 | 46.51 | 47.26 | 47.11 | 46.86 | 46.36 |
| Base Stock – Group III | 30 | 30 | 30 | 30 | 30 | 30 |
| Base Stock – Group V | 5 | 5 | 5 | 5 | 5 | 5 |
| Ethoxylated Fatty Ester | 0.5 | 1 | 0.1 | 0.25 | 0.5 | 1 |
| Mixed Glyceride Ester | 0.1 | 0.1 | 0.25 | 0.25 | 0.25 | 0.25 |
| Rest of Formulation (constant) | 17.39 | 17.39 | 17.39 | 17.39 | 17.39 | 17.39 |
| Total | 100 | 100 | 100 | 100 | 100 | 100 |
| Calcium, wt.% | 0.235 | 0.235 | 0.235 | 0.235 | 0.235 | 0.235 |
| Magnesium, wt.% | 0.000 | 0.000 | 0.000 | 0.000 | 0.000 | 0.000 |
| Boron, wt.% | 0.010 | 0.010 | 0.010 | 0.010 | 0.010 | 0.010 |
| Phosphorus, wt.% | 0.065 | 0.065 | 0.065 | 0.065 | 0.065 | 0.065 |
| Zinc, wt.% | 0.072 | 0.072 | 0.072 | 0.072 | 0.072 | 0.072 |
| Molybdenum, wt.% | 0.008 | 0.008 | 0.008 | 0.008 | 0.008 | 0.008 |
| Sulfated Ash, wt.% | 0.96 | 0.95 | 0.95 | 0.95 | 0.96 | 0.95 |
| TBN 2896, mg KOH/g | 9.2 | 9.2 | 9.2 | 9.2 | 9.2 | 9.2 |
| TBN 4739, mg KOH/g | 7.3 | 7.3 | 7.3 | 7.3 | 7.3 | 7.3 |
| MTM Integrated Area 140°C | 0.166 | 0.162 | 0.156 | 0.162 | 0.159 | 0.167 |
| TEOST 33C Total Deposits, mg | 27 | 36 | 31 | 25 | 20 | 38 |
| Kinematic Viscosity 100C, mm2/s | 8.8 | 9.0 | 8.7 | 8.8 | 8.8 | 9.0 |

Fig. 5 (Cont.)

| Name | Inventive Example 11 | Inventive Example 12 | Inventive Example 13 | Inventive Example 14 | Inventive Example 15 | Inventive Example 16 |
|---|---|---|---|---|---|---|
| Base Stock – Group IV | 47.01 | 46.86 | 46.61 | 46.11 | 46.51 | 86.36 |
| Base Stock – Group III | 30 | 30 | 30 | 30 | 30 | 30 |
| Base Stock – Group V | 5 | 5 | 5 | 5 | 5 | 5 |
| Ethoxylated Fatty Ester | 0.1 | 0.25 | 0.5 | 1 | 0.1 | 0.25 |
| Mixed Glyceride Ester | 0.5 | 0.5 | 0.5 | 0.5 | 1 | 1 |
| Rest of Formulation (constant) | 17.39 | 17.39 | 17.39 | 17.39 | 17.39 | 17.39 |
| Total | 100 | 100 | 100 | 100 | 100 | 100 |
| Calcium, wt.% | 0.235 | 0.235 | 0.235 | 0.235 | 0.235 | 0.235 |
| Magnesium, wt.% | 0.000 | 0.000 | 0.000 | 0.000 | 0.000 | 0.000 |
| Boron, wt.% | 0.010 | 0.010 | 0.010 | 0.010 | 0.010 | 0.010 |
| Phosphorus, wt.% | 0.065 | 0.065 | 0.065 | 0.065 | 0.065 | 0.065 |
| Zinc, wt.% | 0.072 | 0.072 | 0.072 | 0.072 | 0.072 | 0.072 |
| Molybdenum, wt.% | 0.008 | 0.008 | 0.008 | 0.008 | 0.008 | 0.008 |
| Sulfated Ash, wt.% | 0.95 | 0.95 | 0.95 | 0.96 | 0.95 | 0.95 |
| TBN 2896, mg KOH/g | 9.2 | 9.2 | 9.2 | 9.2 | 9.2 | 9.2 |
| TBN 4739, mg KOH/g | 7.3 | 7.3 | 7.3 | 7.3 | 7.3 | 7.3 |
| MTM Integrated Area 140°C | 0.166 | 0.155 | 0.155 | 0.157 | 0.181 | 0.164 |
| TEOST 33C Total Deposits, mg | 11 | 13 | 20 | 19 | 12 | 20 |
| Kinematic Viscosity 100C, mm2/s | 8.7 | 8.7 | 8.8 | 9.0 | 8.7 | 8.7 |

Fig. 5 (Cont.)

| Name | Inventive Example 17 | Inventive Example 18 | Inventive Example 19 | Comparative Example 6 |
|---|---|---|---|---|
| Base Stock – Group IV | 46.11 | 45.61 | | |
| Base Stock – Group III | 30 | 30 | | |
| Base Stock – Group V | 5 | 5 | | |
| Group I Base Oil | | | 81.89 | |
| Group II Base Oil | | | | 81.89 |
| Ethoxylated Fatty Ester | 0.5 | 1 | 0.52 | 0.52 |
| Mixed Glyceride Ester | 1 | 1 | 0.2 | 0.2 |
| Rest of Formulation (constant) | 17.39 | 17.39 | 17.39 | 17.39 |
| Total | 100 | 100 | 100 | 100 |
| Calcium, wt.% | 0.235 | 0.235 | 0.235 | 0.235 |
| Magnesium, wt.% | 0.000 | 0.000 | 0.000 | 0.000 |
| Boron, wt.% | 0.010 | 0.010 | 0.010 | 0.010 |
| Phosphorus, wt.% | 0.065 | 0.065 | 0.065 | 0.065 |
| Zinc, wt.% | 0.072 | 0.072 | 0.072 | 0.072 |
| Molybdenum, wt.% | 0.008 | 0.008 | 0.008 | 0.008 |
| Sulfated Ash, wt.% | 0.95 | 0.96 | 0.95 | 0.95 |
| TBN 2896, mg KOH/g | 9.2 | 9.2 | 9.2 | 9.2 |
| TBN 4739, mg KOH/g | 7.3 | 7.3 | 7.3 | 7.3 |
| MTM Integrated Area 140°C | 0.164 | 0.161 | 0.170 | 0.151 |
| TEOST 33C Total Deposits, mg | 7 | 10 | 32 | 45 |
| Kinematic Viscosity 100C, mm2/s | 8.8 | 9.0 | 10.9 | 9.7 |

Fig. 6

| Name | Comparative Example 4 | Comparative Example 5 | Inventive Example 1 | Inventive Example 20 | Inventive Example 21 |
|---|---|---|---|---|---|
| Base Stock – Group IV | 47.29 | 47.29 | 46.89 | 48.34 | 45.34 |
| Base Stock – Group III | 30 | 30 | 30 | 30 | 30 |
| Base Stock – Group III | 0 | 0 | 0 | 0 | 0 |
| Base Stock – Group V (AN) | 5 | 5 | 5 | 5 | 5 |
| Base Stock – Group V (ester) | 0 | 0 | 0 | 0 | 0 |
| Non-borated PIB Dispersant | 3.25 | 3.25 | 3.25 | 2 | 5 |
| Overbased Calcium Salicylate Detergent | 1.2 | 1.2 | 1.2 | 1.2 | 1.2 |
| Neutral Calcium Salicylate | 5 | 5 | 5 | 5 | 5 |
| Calcium Sulfonate | 0 | 0 | 0 | 0 | 0 |
| Magnesium Sulfonate | 0 | 0 | 0 | 0 | 0 |
| Zinc Dithiophosphate | 0.74 | 0.74 | 0.74 | 0.74 | 0.74 |
| Ethoxylated Fatty Ester | 0 | 0.52 | 0.52 | 0.52 | 0.52 |
| Mixed Glyceride Ester | 0.52 | 0 | 0.2 | 0.2 | 0.2 |
| Rest of Formulation (constant) | 7.05 | 7.05 | 7.05 | 7.05 | 7.05 |
| Total | 100 | 100 | 100 | 100 | 100 |
| Calcium, wt.% | 0.235 | 0.235 | 0.235 | 0.235 | 0.235 |
| Magnesium, wt.% | 0.000 | 0.000 | 0.000 | 0.000 | 0.000 |
| Boron, wt.% | 0.010 | 0.010 | 0.010 | 0.010 | 0.010 |
| Phosphorus, wt.% | 0.065 | 0.065 | 0.065 | 0.065 | 0.065 |
| Zinc, wt.% | 0.072 | 0.072 | 0.072 | 0.072 | 0.072 |
| Molybdenum, wt.% | 0.008 | 0.008 | 0.008 | 0.008 | 0.008 |
| Sulfated Ash, wt.% | 0.95 | 0.95 | 0.95 | 0.95 | 0.95 |
| TBN 2896, mg KOH/g | 9.2 | 9.2 | 9.2 | 8.8 | 9.7 |
| TBN 4739, mg KOH/g | 7.3 | 7.3 | 7.3 | 7.1 | 7.6 |
| MTM Integrated Area 140°C | 0.216 | 0.167 | 0.178 | 0.148 | 0.154 |
| TEOST 33C Total Deposits, mg | 28 | 43 | 30 | 36 | 35 |
| Kinematic Viscosity 100C, mm2/s | 8.6 | 8.8 | 8.8 | 8.3 | 9.5 |

Fig. 6 (Cont.)

| Name | Inventive Example 22 | Inventive Example 23 | Inventive Example 24 | Inventive Example 25 | Inventive Example 26 |
|---|---|---|---|---|---|
| Base Stock – Group IV | 50.04 | 47.04 | 47.04 | 44.04 | 44.31 |
| Base Stock – Group III | 30 | 30 | 30 | 30 | 30 |
| Base Stock – Group III | 0 | 0 | 0 | 0 | 0 |
| Base Stock – Group V (AN) | 5 | 5 | 5 | 5 | 5 |
| Base Stock – Group V (ester) | 0 | 0 | 0 | 0 | 0 |
| Non-borated PIB Dispersant | 2 | 5 | 2 | 5 | 6 |
| Overbased Calcium Salicylate Detergent | 0.5 | 0.5 | 2.5 | 2.5 | 1.2 |
| Neutral Calcium Salicylate | 5 | 5 | 5 | 5 | 5 |
| Calcium Sulfonate | 0 | 0 | 0 | 0 | 0 |
| Magnesium Sulfonate | 0 | 0 | 0 | 0 | 0 |
| Zinc Dithiophosphate | 0.74 | 0.74 | 0.74 | 0.74 | 0.74 |
| Ethoxylated Fatty Ester | 0.52 | 0.52 | 0.52 | 0.52 | 0.25 |
| Mixed Glyceride Ester | 0.2 | 0.2 | 0.2 | 0.2 | 0.5 |
| Rest of Formulation (constant) | 7.05 | 7.05 | 7.05 | 7.05 | 7.05 |
| Total | 100 | 100 | 100 | 100 | 100 |
| Calcium, wt.% | 0.165 | 0.165 | 0.365 | 0.365 | 0.12 |
| Magnesium, wt.% | 0 | 0 | 0 | 0 | 0 |
| Boron, wt.% | 0.010 | 0.010 | 0.010 | 0.010 | 0.010 |
| Phosphorus, wt.% | 0.065 | 0.065 | 0.065 | 0.065 | 0.065 |
| Zinc, wt.% | 0.072 | 0.072 | 0.072 | 0.072 | 0.072 |
| Molybdenum, wt.% | 0.008 | 0.008 | 0.008 | 0.008 | 0.008 |
| Sulfated Ash, wt.% | 0.74 | 0.74 | 1.35 | 1.35 | 0.56 |
| TBN 2896, mg KOH/g | 6.9 | 7.7 | 12.5 | 13.3 | 6.0 |
| TBN 4739, mg KOH/g | 7.6 | 5.1 | 10.7 | 11.3 | 4.1 |
| MTM Integrated Area 140°C | 0.161 | 0.171 | 0.144 | 0.145 | 0.164 |
| TEOST 33C Total Deposits, mg | 40 | 40 | 16 | 26 | 33 |
| Kinematic Viscosity 100C, mm2/s | 8.2 | 9.5 | 8.4 | 9.7 | 9.9 |

Fig. 7

| Name | Inventive Example 27 | Inventive Example 28 | Inventive Example 29 | Inventive Example 30 | Inventive Example 31 | Inventive Example 32 |
|---|---|---|---|---|---|---|
| Base Stock – Group IV | 46.96 | 47.16 | 51.36 | 45.36 | 46.86 | 46.86 |
| Base Stock – Group III | 30 | 30 | 30 | 30 | 35 | 30 |
| Base Stock – Group III | 0 | 0 | 0 | 0 | 0 | 0 |
| Base Stock – Group V (AN) | 5 | 5 | 5 | 5 | 0 | 0 |
| Base Stock – Group V (ester) | 0 | 0 | 0 | 0 | 0 | 5 |
| Non-borated PIB Dispersant | 3.25 | 3.25 | 3.25 | 3.25 | 3.25 | 3.25 |
| Overbased Calcium Salicylate Detergent | 0.3 | 0.1 | 1.2 | 1.2 | 1.2 | 1.2 |
| Neutral Calcium Salicylate | 5 | 5 | 5 | 5 | 5 | 5 |
| Calcium Sulfonate | 0.8 | 0 | 0 | 0 | 0 | 0 |
| Magnesium Sulfonate | 0 | 0.8 | 0 | 0 | 0 | 0 |
| Zinc Dithiophosphate | 0.74 | 0.74 | 0.74 | 0.74 | 0.74 | 0.74 |
| Mo-containing complex | 0.15 | 0.15 | 0.15 | 0.15 | 0.15 | 0.15 |
| Ethoxylated Fatty Ester | 0.25 | 0.25 | 0.25 | 0.25 | 0.25 | 0.25 |
| Mixed Glyceride Ester | 0.5 | 0.5 | 0.5 | 0.5 | 0.5 | 0.5 |
| Rest of Formulation (constant) | 7.05 | 7.05 | 2.55 | 8.55 | 7.05 | 7.05 |
| Total | 100 | 100 | 100 | 100 | 100 | 100 |
| Calcium, wt.% | 0.2386 | 0.125 | 0.235 | 0.235 | 0.235 | 0.235 |
| Magnesium, wt.% | 0 | 0.0744 | 0 | 0 | 0 | 0 |
| Boron, wt.% | 0.010 | 0.010 | 0.010 | 0.010 | 0.010 | 0.010 |
| Phosphorus, wt.% | 0.065 | 0.065 | 0.065 | 0.065 | 0.065 | 0.065 |
| Zinc, wt.% | 0.072 | 0.072 | 0.072 | 0.072 | 0.072 | 0.072 |
| Molybdenum, wt.% | 0.008 | 0.008 | 0.008 | 0.008 | 0.008 | 0.008 |
| Sulfated Ash, wt.% | 0.95 | 0.95 | 0.95 | 0.95 | 0.95 | 0.95 |
| TBN 2896, mg KOH/g | 9.0 | 9.3 | 9.2 | 9.2 | 9.2 | 9.2 |
| TBN 4739, mg KOH/g | 5.7 | 7.5 | 7.3 | 7.3 | 7.3 | 7.3 |
| MTM Integrated Area 140°C | 0.139 | 0.168 | 0.145 | 0.133 | 0.141 | 0.149 |
| TEOST 33C Total Deposits, mg | 31.8 | 34.2 | 34.0 | 22.2 | 14.3 | 8.1 |
| Kinematic Viscosity 100C, mm2/s | 8.8 | 8.8 | 5.8 | 10.8 | 8.7 | 8.7 |

Fig 7 (cont)

| Name | Inventive Example 33 | Inventive Example 34 | Inventive Example 35 | Inventive Example 36 | Comparative Example 6 | Comparative Example 7 |
|---|---|---|---|---|---|---|
| Base Stock – Group IV | 47.01 | 46.56 | 46.86 | 47.2 | 46.45 | 51.42 |
| Base Stock – Group III | 30 | 30 | 0 | 30 | 30 | 30 |
| Base Stock – Group III | 0 | 0 | 30 | 0 | 0 | 0 |
| Base Stock – Group V (AN) | 5 | 5 | 5 | 5 | 5 | 5 |
| Base Stock – Group V (ester) | 0 | 0 | 0 | 0 | 0 | 0 |
| Non-borated PIB Dispersant | 3.25 | 3.25 | 3.25 | 3.25 | 3.25 | 3.25 |
| Overbased Calcium Salicylate Detergent | 1.2 | 1.2 | 1.2 | 1.2 | 1.2 | 1.2 |
| Neutral Calcium Salicylate | 5 | 5 | 5 | 5 | 5 | 0 |
| Calcium Sulfonate | 0 | 0 | 0 | 0 | 0 | 0 |
| Magnesium Sulfonate | 0 | 0 | 0 | 0 | 0 | 0 |
| Zinc Dithiophosphate | 0.74 | 0.74 | 0.74 | 0.4 | 1.15 | 1.15 |
| Mo-containing complex | 0 | 0.45 | 0.15 | 0.15 | 0.15 | 0.15 |
| Ethoxylated Fatty Ester | 0.25 | 0.25 | 0.25 | 0.25 | 0.25 | 0.25 |
| Mixed Glyceride Ester | 0.5 | 0.5 | 0.5 | 0.5 | 0.5 | 0.5 |
| Rest of Formulation (constant) | 12.05 | 12.05 | 12.05 | 12.05 | 12.05 | 7.05 |
| Total | 100 | 100 | 100 | 100 | 100 | 100 |
| Calcium, wt.% | 0.235 | 0.235 | 0.235 | 0.235 | 0.235 | 0.12 |
| Magnesium, wt.% | 0 | 0 | 0 | 0 | 0 | 0 |
| Boron, wt.% | 0.010 | 0.010 | 0.010 | 0.010 | 0.010 | 0.010 |
| Phosphorus, wt.% | 0.065 | 0.065 | 0.065 | 0.035 | 0.102 | 0.065 |
| Zinc, wt.% | 0.072 | 0.072 | 0.072 | 0.039 | 0.111 | 0.072 |
| Molybdenum, wt.% | 0.000 | 0.025 | 0.008 | 0.008 | 0.008 | 0.008 |
| Sulfated Ash, wt.% | 0.95 | 0.95 | 0.95 | 0.86 | 1.06 | 0.56 |
| TBN 2896, mg KOH/g | 9.2 | 9.2 | 9.2 | 9.2 | 9.2 | 6.0 |
| TBN 4739, mg KOH/g | 7.3 | 7.3 | 7.3 | 7.3 | 7.3 | 4.1 |
| MTM Integrated Area 140°C | 0.155 | 0.136 | 0.136 | 0.135 | 0.163 | 0.185 |
| TEOST 33C Total Deposits, mg | 27.6 | 29.6 | 14.1 | 23.6 | 43.3 | 44.3 |
| Kinematic Viscosity 100C, mm2/s | 8.7 | 8.8 | 8.7 | 8.7 | 8.8 | 8.3 |

Figure 8

| | | | Comparative Example 8 | Inventive Example 37 | Inventive Example 38 |
|---|---|---|---|---|---|
| | Base Stock – Group II | | 0 | 0 | 0 |
| | Base Stock - Group III | | 30 | 30 | 30 |
| | Base Stock - Group IV | wt% | 49.71 | 49.46 | 49.21 |
| | Base Stock - Group V (alkylated naphthalene) | wt% | 5.00 | 5.00 | 5.00 |
| | Remainder of Formulation | wt% | 14.62 | 14.62 | 14.62 |
| | Molybdenum Organic Complex | wt% | 0.15 | 0.15 | 0.15 |
| | Mixed glyceride ester | wt% | 0.52 | 0.52 | 0.52 |
| | Ethoxylated fatty ester | wt% | 0.00 | 0.25 | 0.50 |
| | | | | | |
| | Calcium | wt% | 0.110 | 0.110 | 0.110 |
| | Magnesium | wt% | 0.076 | 0.076 | 0.076 |
| | Phosphorus | wt% | 0.065 | 0.065 | 0.065 |
| | Boron | wt% | 0.010 | 0.010 | 0.010 |
| | Ash | wt% | 0.880 | 0.880 | 0.880 |
| | Zinc | wt% | 0.072 | 0.072 | 0.072 |
| | Molybdenum | wt% | 0.008 | 0.008 | 0.008 |
| D445 | Kinematic Viscosity at 100 C | cSt | 8.4 | 8.5 | 8.5 |
| D4683 | HTHS Tapered Bearing Visc Test | cP | 2.6 | 2.6 | 2.6 |
| D5293 | App. Viscosity @ Low Temp. -35C | cP | 3720 | 3780 | 3960 |
| D5800 | NOACK Procedure B | % | 10.5 | 10.5 | 10.5 |
| | | | | | |
| | SAE Grade | | 0W-20 | 0W-20 | 0W-20 |
| | Astra NEDC FEI vs. 5W-30 Reference Oil | % | 0.04 | 0.40 | 0.52 |

METHOD FOR IMPROVING ENGINE FUEL EFFICIENCY

CROSS-REFERENCE TO RELATED APPLICATIONS

This application is a Continuation-in-Part application and claims priority to pending U.S. application Ser. No. 14/219,284, filed on Mar. 19, 2014, the entirety of which is incorporated herein by reference, which claims the benefit of U.S. Provisional Application No. 61/920,169 filed Dec. 23, 2013, herein also incorporated by reference.

FIELD

This disclosure relates to improving fuel efficiency and friction reduction properties, while maintaining or improving deposit control, in an engine lubricated with a lubricating oil by including a friction modifier mixture, in the lubricating oil.

BACKGROUND

Fuel efficiency requirements for passenger vehicles are becoming increasingly more stringent. New legislation in the United States and European Union within the past few years has set fuel economy and emissions targets not readily achievable with today's vehicle and lubricant technology.

To address these increasing standards, automotive original equipment manufacturers are demanding better fuel economy as a lubricant-related performance characteristic, while maintaining deposit control and oxidative stability requirements. One well known way to increase fuel economy is to decrease the viscosity of the lubricating oil. However, this approach is now reaching the limits of current equipment capabilities and specifications. At a given viscosity, it is well known that adding organic or organic metallic friction modifiers reduces the surface friction of the lubricating oil and allows for better fuel economy. However these additives often bring with them detrimental effects such as increased deposit formation, seals impacts, or they out-compete the anti-wear components for limited surface sites, thereby not allowing the formation of an anti-wear film, causing increased wear.

Contemporary lubricants such as engine oils use mixtures of additives such as dispersants, detergents, inhibitors, viscosity index improvers and the like to provide engine cleanliness and durability under a wide range of performance conditions of temperature, pressure, and lubricant service life.

Lubricant-related performance characteristics such as high temperature deposit control and fuel economy are extremely advantageous attributes as measured by a variety of bench and engine tests. As indicated above, it is known that adding organic friction modifiers to a lubricant formulation imparts frictional benefits at low temperatures, consequently improving the lubricant fuel economy performance. At high temperatures, however, adding increased levels of organic friction modifier can invite high temperature performance issues. For example, engine deposits are undesirable consequences of high levels of friction modifier in an engine oil formulation at high temperature engine operation.

A major challenge in engine oil formulation is simultaneously achieving high temperature deposit control while also achieving improved fuel economy.

Despite the advances in lubricant oil formulation technology, there exists a need for an engine oil lubricant that effectively improves fuel economy while maintaining or improving friction reduction properties and deposit control.

SUMMARY

This disclosure relates in part to a method for improving fuel efficiency and reducing frictional properties, while maintaining or improving deposit control, in an engine lubricated with a lubricating oil by including a friction modifier mixture in the lubricating oil. The lubricating oils of this disclosure are useful in internal combustion engines including direct injection, gasoline and diesel engines.

This disclosure also relates in part to a method for improving fuel efficiency and reducing frictional properties, while maintaining or improving deposit control, in an engine lubricated with a lubricating oil by using as the lubricating oil a formulated oil. The formulated oil has a composition comprising from 75 to 95 wt % of lubricating oil base stock including a Group I base stock or a combination of a Group III, Group IV and Group V base stock comprising from 30 to 35 wt % Group III, 45 to 55 wt % Group IV and 0 to 5 wt % Group V; a friction modifier mixture comprising a polymeric ethoxylated fatty acid ester at from 0.1 to 1.0 wt. % and a mixed glyceride ester at from 0.1 to 1.0 wt. %, and wherein the remainder of the lubricating engine oil includes one or more other lubricating oil additives; wherein fuel efficiency and friction reduction properties are improved (mini-traction machine (MTM) in Stribeck mode friction coefficient at 140° C. less than or equal to 0.20) and deposit control is maintained or improved (TEOST 33C total deposits less than or equal to 40 mg) as compared to friction reduction properties and deposit control achieved using a lubricating engine oil not containing the friction modifier mixture.

This disclosure further relates in part to a lubricating engine oil having a composition comprising from 75 to 95 wt % of lubricating oil base stock including a Group I base stock or a combination of a Group III, Group IV and Group V base stock comprising from 30 to 35 wt % Group III, 45 to 55 wt % Group IV and 0 to 5 wt % Group V; a friction modifier mixture comprising a polymeric ethoxylated fatty acid ester at from 0.1 to 1.0 wt. % and a mixed glyceride ester at from 0.1 to 1.0 wt. %, and wherein the remainder of the lubricating engine oil includes one or more other lubricating oil additives; wherein fuel efficiency and friction reduction properties are improved (mini-traction machine (MTM) in Stribeck mode friction coefficient at 140° C. less than or equal to 0.20) and deposit control is maintained or improved (TEOST 33C total deposits less than or equal to 40 mg) as compared to friction reduction properties and deposit control achieved using a lubricating engine oil not containing the friction modifier mixture.

It has been surprisingly found that, in accordance with this disclosure, improvements in fuel economy and friction reduction properties are obtained without sacrificing engine cleanliness (e.g., while maintaining or improving deposit control) in an engine lubricated with a lubricating oil, by including a friction modifier mixture in the lubricating oil.

Other objects and advantages of the present disclosure will become apparent from the detailed description that follows.

BRIEF DESCRIPTION OF THE DRAWINGS

FIG. 1 shows a comparison of testing results of three 0W-20 oils for cleanliness and friction in accordance with embodiments of this disclosure.

FIG. 4 shows formulation embodiments of this disclosure (e.g., organic friction modifier boost). Formulation details are shown in weight percent based on the total weight percent of the formulation, of various formulations. FIG. 4 also shows the results of bench testing of the formulations using thermo-oxidation engine oil simulation test (TEOST 33C).

FIG. 5 shows formulation details in weight percent based on the total weight percent of the formulation, of various inventive and comparative formulations. FIG. 5 also shows the results of bench testing of the formulations using thermo-oxidation engine oil simulation test TEOST 33C and MTM friction.

FIG. 6 shows formulation details in weight percent based on the total weight percent of the formulation, of various inventive and comparative formulations. FIG. 6 also shows the results of bench testing of the formulations using thermo-oxidation engine oil simulation test TEOST 33C and MTM friction.

FIG. 7 depicts other exemplary inventive and comparative lubricant formulations of the present disclosure with individual contributions of components used in such formulations.

FIG. 8 depicts still other comparative and exemplary inventive formulations of the present disclosure with individual contributions of components used in such formulations.

DETAILED DESCRIPTION

Figure 2:
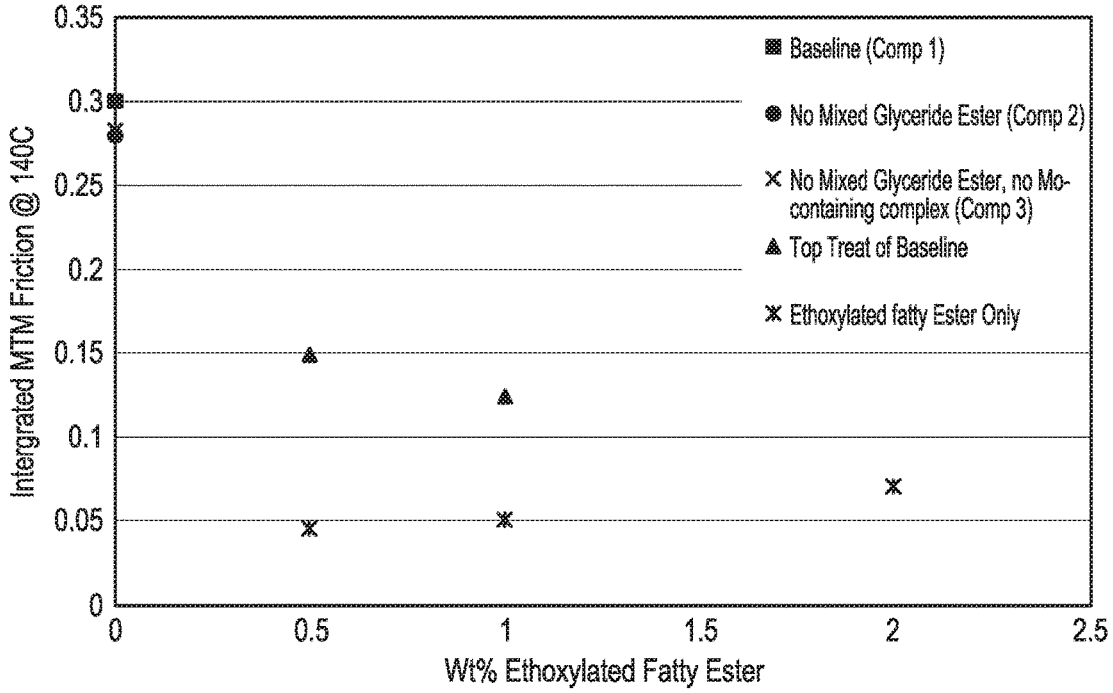
FIG. 2 graphically shows average integrated Stribeck friction coefficients from mini-traction machine (MTM) measurements performed at 140° C. as a function of ethoxylated fatty ester treat rate.

All numerical values within the detailed description and the claims herein are modified by "about" or "approximately" the indicated value, and take into account experimental error and variations that would be expected by a person having ordinary skill in the art.

It has now been found that improved fuel efficiency and friction reduction properties can be attained, while deposit control is unexpectedly maintained or improved, in an engine lubricated with a lubricating oil by using as the lubricating oil a formulated oil that has a friction modifier mixture. The formulated oil preferably comprises a lubricating oil base stock as a major component, and a friction modifier mixture, and optionally a metal dialkyl dithio phosphate, and/or a viscosity index improver, as minor components. The lubricating oils of this disclosure are particularly advantageous as passenger vehicle engine oil (PVEO) products.

The lubricating oils of this disclosure provide excellent engine protection including friction reduction and anti-wear performance. This benefit has been demonstrated for the lubricating oils of this disclosure in the Sequence VID (ASTM D7589) engine tests. The lubricating oils of this disclosure provide improved fuel efficiency. A lower HTHS viscosity engine oil generally provides superior fuel economy to a higher HTHS viscosity product. This benefit has been demonstrated for the lubricating oils of this disclosure in the Sequence VID Fuel Economy (ASTM D7589) engine test.

The lubricating engine oils of this disclosure have a composition sufficient to pass wear protection requirements of one or more engine tests selected from Sequence VID and others.

In comparison with fuel efficiency achieved using a lubricating engine oil containing a minor component other than the friction modifier mixture, the lubricating engine oils containing the friction modifier mixture of this disclosure can exhibit a fuel efficiency improvement preferably greater than 10%, as determined by the Sequence VID Fuel Economy (ASTM D7589) engine test.

In one form of the present disclosure, provided is a lubricating engine oil that includes from 75 to 95 wt % of lubricating oil base stock including a Group I base stock or a combination of a Group III, Group IV and Group V base stock comprising from 30 to 35 wt % Group III, 45 to 55 wt % Group IV and 0 to 5 wt % Group V with a friction modifier mixture comprising a polymeric ethoxylated fatty acid ester at from 0.1 to 1.0 wt. % and a mixed glyceride ester at from 0.1 to 1.0 wt. %. The remainder of the lubricating engine oil includes one or more other lubricating oil additives. The inventive lubricating engine oil provides improved fuel efficiency and friction reduction properties as measured by a mini-traction machine (MTM) in Stribeck mode to yield a friction coefficient at 140° C. less than or equal to 0.20. The inventive lubricating engine oil also provides deposit control that is maintained or improved as measured by the TEOST 33C test to yield total deposits less than or equal to 40 mg. The friction reduction properties and deposit control achieved using the inventive lubricating engine oil are significantly and surprisingly improved compared to lubricating engine oils not containing the friction modifier mixture.

The one or more other lubricating oil additives constitute the remainder of the formulated oil and are selected from one or more of the following: anti-wear additive, viscosity index improver, antioxidant, detergent, dispersant, pour point depressant, corrosion inhibitor, metal deactivator, seal compatibility additive, anti-foam agent, inhibitor, anti-rust additive, and organic metallic friction. These one or more other lubricating oil additives are described in greater detail below.

The inventive lubricating engine oils of the instant disclosure have a combination of lubricating oil base stocks, a friction modifier mixture and other lubricating oil additives that yield an elemental phosphorous level in the lubricating engine oil of from 0.035 to 0.076 wt %, or 0.040 to 0.070 wt %, or 0.045 to 0.065 wt %, or 0.050 to 0.060 of the lubricating engine oil.

The inventive lubricating engine oils of the instant disclosure also have a combination of lubricating oil base stocks, a friction modifier mixture and other lubricating oil additives that yield an elemental molybdenum level in the lubricating engine oil of from 0.0 to 0.025 wt %, or 0.005 to 0.020 wt %, or 0.010 to 0.015 wt % of the lubricating engine oil.

In another form of the present disclosure, provided is a method for improving fuel efficiency and reducing frictional properties, while maintaining or improving deposit control, in an engine lubricated with a lubricating oil by using as the lubricating engine oil a formulated oil, said formulated oil having a composition including: from 75 to 95 wt % of lubricating oil base stock including a Group I base stock or a combination of a Group III, Group IV and Group V base stock comprising from 30 to 35 wt % Group III, 45 to 55 wt % Group IV and 0 to 5 wt % Group V; and a friction modifier mixture comprising a polymeric ethoxylated fatty acid ester at from 0.1 to 1.0 wt. % and a mixed glyceride ester at from 0.1 to 1.0 wt. %. The remainder of the lubricating engine oil includes one or more other lubricating oil additives. The inventive method provides improved fuel efficiency and friction reduction properties as measured by a mini-traction machine (MTM) in Stribeck mode to yield a friction coefficient at 140° C. less than or equal to 0.20. The inventive method also provides deposit control that is maintained or improved as measured by the TEOST 33C test to yield total deposits less than or equal to 40 mg. The friction reduction properties and deposit control achieved using the inventive method are significantly and surprisingly improved compared to lubricating engine oils not containing the friction modifier mixture.

The inventive lubricating engine oils described above have a kinematic viscosity, according to ASTM standards, of 2 cSt to 12 cSt (or $mm^2/s$) at 100° C., preferably of 4 cSt to 12 cSt (or $mm^2/s$) at 100° C., more preferably of 4 cSt to 8 cSt (or $mm^2/s$) at 100° C., and even more preferably of 4 cSt to 6 cSt (or $mm^2/s$) at 100° C.

The inventive lubricating engine oil and the inventive method for improving fuel efficiency, frictional properties and deposit control provides improved deposit control as measured by the TEOST 33C test to yield total deposits less than or equal to 40 mg, or less than or equal to 30 mg, or less than or equal to 20 mg, or less than or equal to 10 mg. The inventive lubricating engine oil and the inventive method for improving fuel efficiency, frictional properties and deposit control provides improved fuel efficiency and friction reduction properties as measured by a mini-traction machine (MTM) test in Stribeck mode to yield a friction coefficient at 140° C. less than or equal to 0.20, or less than or equal to 0.18, or less than or equal to 0.16, or less than or equal to 0.14, or less than or equal to 0.12, or less than or equal to 0.10, or less than or equal to 0.08.

The inventive lubricating engine oil and the inventive method for improving fuel efficiency, frictional properties and deposit control provides improved fuel economy of a vehicle as measured by the New European Drive Cycle (NEDC) vehicle fuel economy test of at least 0.04%, or at least 0.10%, or at least 0.15%, or at least 0.20%, or at least 0.25%, or at least 0.30%, or at least 0.35%, or at least 0.40%, or at least 0.45%, or at least 0.50%, or at least 0.52% compared to a lubricating engine oil not containing the friction modifier mixture.

Lubricating Oil Base Stocks

A wide range of lubricating base oils is known in the art. Lubricating base oils that are useful in the present disclosure are both natural oils, and synthetic oils, and unconventional oils (or mixtures thereof) can be used unrefined, refined, or rerefined (the latter is also known as reclaimed or reprocessed oil). Unrefined oils are those obtained directly from a natural or synthetic source and used without added purification. These include shale oil obtained directly from retorting operations, petroleum oil obtained directly from primary distillation, and ester oil obtained directly from an esterification process. Refined oils are similar to the oils discussed for unrefined oils except refined oils are subjected to one or more purification steps to improve at least one lubricating oil property. One skilled in the art is familiar with many purification processes. These processes include solvent extraction, secondary distillation, acid extraction, base extraction, filtration, and percolation. Rerefined oils are obtained by processes analogous to refined oils but using an oil that has been previously used as a feed stock.

Groups I, II, III, IV and V are broad base oil stock categories developed and defined by the American Petroleum Institute (API Publication 1509; www.API.org to create guidelines for lubricant base oils. Group I base stocks have a viscosity index of between 80 to 120 and contain greater than 0.03% sulfur and/or less than 90% saturates. Group II base stocks have a viscosity index of between 80 to 120, and contain less than or equal to 0.03% sulfur and greater than or equal to 90% saturates. Group III stocks have a viscosity index greater than 120 and contain less than or equal to 0.03% sulfur and greater than 90% saturates. Group IV includes polyalphaolefins (PAO). Group V base stock includes base stocks not included in Groups I-IV. Table 1 below summarizes properties of each of these five groups.

| | Base Oil Properties | | |
|---|---|---|---|
| | Saturates | Sulfur | Viscosity Index |
| Group I | <90 and/or | >0.03% and | ≥80 and <120 |
| Group II | ≥90 and | ≤0.03% and | ≥80 and <120 |
| Group III | ≥90 and | ≤0.03% and | ≥120 |
| Group IV | Polyalphaolefins (PAO) | | |
| Group V | All other base oil stocks not included in Groups I, II, III or IV | | |

Natural oils include animal oils, vegetable oils (castor oil and lard oil, for example), and mineral oils. Animal and vegetable oils possessing favorable thermal oxidative stability can be used. Of the natural oils, mineral oils are preferred. Mineral oils vary widely as to their crude source, for example, as to whether they are paraffinic, naphthenic, or mixed paraffinic-naphthenic. Oils derived from coal or shale are also useful. Natural oils vary also as to the method used for their production and purification, for example, their distillation range and whether they are straight run or cracked, hydrorefined, or solvent extracted.

Group II and/or Group III hydroprocessed or hydrocracked basestocks, including synthetic oils such as polyalphaolefins, alkyl aromatics and synthetic esters are also well known basestock oils.

Synthetic oils include hydrocarbon oil. Hydrocarbon oils include oils such as polymerized and interpolymerized olefins (polybutylenes, polypropylenes, propylene isobutylene copolymers, ethylene-olefin copolymers, and ethylene-alphaolefin copolymers, for example). Polyalphaolefin (PAO) oil base stocks are commonly used synthetic hydrocarbon oil. By way of example, PAOs derived from $C_6$, $C_8$, $C_{10}$, $C_{12}$, $C_{14}$ olefins or mixtures thereof may be utilized. See U.S. Pat. Nos. 4,956,122; 4,827,064; and 4,827,073.

The number average molecular weights of the PAOs, which are known materials and generally available on a major commercial scale from suppliers such as ExxonMobil Chemical Company, Chevron Phillips Chemical Company, BP, and others, typically vary from 250 to 3,000, although PAO's may be made in viscosities up to 100 cSt (100° C.). The PAOs are typically comprised of relatively low molecular weight hydrogenated polymers or oligomers of alphaolefins which include, but are not limited to, $C_2$ to $C_{32}$ alphaolefins with the $C_8$ to $C_{16}$ alphaolefins, such as 1-hexene, 1-octene, 1-decene, 1-dodecene and the like, being preferred. The preferred polyalphaolefins are poly-1-hexene, poly-1-octene, poly-1-decene and poly-1-dodecene and mixtures thereof and mixed olefin-derived polyolefins. However, the dimers of higher olefins in the range of $C_{14}$ to $C_{18}$ may be used to provide low viscosity base stocks of acceptably low volatility. Depending on the viscosity grade and the starting oligomer, the PAOs may be predominantly trimers and tetramers of the starting olefins, with minor amounts of the higher oligomers, having a viscosity range of 1.5 to 12 cSt. PAO fluids of particular use may include 3.0 cSt, 3.4 cSt, and/or 3.6 cSt and combinations thereof. Bi-modal mixtures of PAO fluids having a viscosity range of 1.5 to 100 cSt may be used if desired.

The PAO fluids may be conveniently made by the polymerization of an alphaolefin in the presence of a polymerization catalyst such as the Friedel-Crafts catalysts including, for example, aluminum trichloride, boron trifluoride or complexes of boron trifluoride with water, alcohols such as ethanol, propanol or butanol, carboxylic acids or esters such as ethyl acetate or ethyl propionate. For example the methods disclosed by U.S. Pat. No. 4,149,178 or 3,382,291 may be conveniently used herein. Other descriptions of PAO synthesis are found in the following U.S. Pat. Nos. 3,742,082; 3,769,363; 3,876,720; 4,239,930; 4,367,352; 4,413,156; 4,434,408; 4,910,355; 4,956,122; and 5,068,487. The dimers of the $C_{14}$ to $C_{18}$ olefins are described in U.S. Pat. No. 4,218,330.

Other useful lubricant oil base stocks include wax isomerate base stocks and base oils, comprising hydroisomerized waxy stocks (e.g. waxy stocks such as gas oils, slack waxes, fuels hydrocracker bottoms, etc.), hydroisomerized Fischer-Tropsch waxes, Gas-to-Liquids (GTL) base stocks and base oils, and other wax isomerate hydroisomerized base stocks and base oils, or mixtures thereof Fischer-Tropsch waxes, the high boiling point residues of Fischer-Tropsch synthesis, are highly paraffinic hydrocarbons with very low sulfur content. The hydroprocessing used for the production of such base stocks may use an amorphous hydrocracking/hydroisomerization catalyst, such as one of the specialized lube hydrocracking (LHDC) catalysts or a crystalline hydrocracking/hydroisomerization catalyst, preferably a zeolitic catalyst. For example, one useful catalyst is ZSM-48 as described in U.S. Pat. No. 5,075,269, the disclosure of which is incorporated herein by reference in its entirety. Processes for making hydrocracked/hydroisomerized distillates and hydrocracked/hydroisomerized waxes are described, for example, in U.S. Pat. Nos. 2,817,693; 4,975,177; 4,921,594 and 4,897,178 as well as in British Patent Nos. 1,429,494; 1,350,257; 1,440,230 and 1,390,359. Each of the aforementioned patents is incorporated herein in their entirety. Particularly favorable processes are described in European Patent Application Nos. 464546 and 464547, also incorporated herein by reference. Processes using Fischer-Tropsch wax feeds are described in U.S. Pat. Nos. 4,594,172 and 4,943,672, the disclosures of which are incorporated herein by reference in their entirety.

Gas-to-Liquids (GTL) base oils, Fischer-Tropsch wax derived base oils, and other wax-derived hydroisomerized (wax isomerate) base oils be advantageously used in the instant disclosure, and may have useful kinematic viscosities at 100° C. of 3 cSt to 50 cSt, preferably 3 cSt to 30 cSt, more preferably 3.5 cSt to 25 cSt, as exemplified by GTL 4 with kinematic viscosity of 4.0 cSt at 100° C. and a viscosity index of 141. These Gas-to-Liquids (GTL) base oils, Fischer-Tropsch wax derived base oils, and other wax-derived hydroisomerized base oils may have useful pour points of −20° C. or lower, and under some conditions may have advantageous pour points of −25° C. or lower, with useful pour points of −30° C. to −40° C. or lower. Useful compositions of Gas-to-Liquids (GTL) base oils, Fischer-Tropsch wax derived base oils, and wax-derived hydroisomerized base oils are recited in U.S. Pat. Nos. 6,080,301; 6,090,989, and 6,165,949 for example, and are incorporated herein in their entirety by reference.

The hydrocarbyl aromatics can be used as base oil or base oil component and can be any hydrocarbyl molecule that contains at least 5% of its weight derived from an aromatic moiety such as a benzenoid moiety or naphthenoid moiety, or their derivatives. These hydrocarbyl aromatics include alkyl benzenes, alkyl naphthalenes, alkyl diphenyl oxides, alkyl naphthols, alkyl diphenyl sulfides, alkylated bis-phenol A, alkylated thiodiphenol, and the like. The aromatic can be mono-alkylated, dialkylated, polyalkylated, and the like. The aromatic can be mono- or poly-functionalized. The hydrocarbyl groups can also be comprised of mixtures of alkyl groups, alkenyl groups, alkynyl, cycloalkyl groups, cycloalkenyl groups and other related hydrocarbyl groups. The hydrocarbyl groups can range from $C_6$ up to $C_{60}$ with a range of $C_8$ to $C_{20}$ often being preferred. A mixture of hydrocarbyl groups is often preferred, and up to three such substituents may be present.

The hydrocarbyl group can optionally contain sulfur, oxygen, and/or nitrogen containing substituents. The aromatic group can also be derived from natural (petroleum) sources, provided at least 5% of the molecule is comprised of an above-type aromatic moiety. Viscosities at 100° C. of approximately 3 cSt to 50 cSt are preferred, with viscosities of approximately 3.4 cSt to 20 cSt often being more preferred for the hydrocarbyl aromatic component. In one embodiment, an alkyl naphthalene where the alkyl group is primarily comprised of 1-hexadecene is used. Other alkylates of aromatics can be advantageously used. Naphthalene or methyl naphthalene, for example, can be alkylated with olefins such as octene, decene, dodecene, tetradecene or higher, mixtures of similar olefins, and the like. Useful concentrations of hydrocarbyl aromatic in a lubricant oil composition can be 2% to 25%, preferably 4% to 20%, and more preferably 4% to 15%, depending on the application.

Alkylated aromatics such as the hydrocarbyl aromatics of the present disclosure may be produced by well-known Friedel-Crafts alkylation of aromatic compounds. See Friedel-Crafts and Related Reactions, Olah, G. A. (ed.), Interscience Publishers, New York, 1963. For example, an aromatic compound, such as benzene or naphthalene, is alkylated by an olefin, alkyl halide or alcohol in the presence of a Friedel-Crafts catalyst. See Friedel-Crafts and Related Reactions, Vol. 2, part 1, chapters 14, 17, and 18, See Olah, G. A. (ed.), Inter-science Publishers, New York, 1964. Many homogeneous or heterogeneous, solid catalysts are known to one skilled in the art. The choice of catalyst depends on the reactivity of the starting materials and product quality requirements. For example, strong acids such as $AlCl_3$, BF3, or HF may be used. In some cases, milder catalysts such as $FeCl_3$ or $SnCl_4$ are preferred. Newer alkylation technology uses zeolites or solid super acids.

Esters comprise a useful base stock. Additive solvency and seal compatibility characteristics may be secured by the use of esters such as the esters of dibasic acids with monoalkanols and the polyol esters of monocarboxylic acids. Esters of the former type include, for example, the esters of dicarboxylic acids such as phthalic acid, succinic acid, alkyl succinic acid, alkenyl succinic acid, maleic acid, azelaic acid, suberic acid, sebacic acid, fumaric acid, adipic acid, linoleic acid dimer, malonic acid, alkyl malonic acid, alkenyl malonic acid, etc., with a variety of alcohols such as butyl alcohol, hexyl alcohol, dodecyl alcohol, 2-ethylhexyl alcohol, etc. Specific examples of these types of esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, etc.

Particularly useful synthetic esters are those which are obtained by reacting one or more polyhydric alcohols, preferably the hindered polyols (such as the neopentyl polyols, e.g., neopentyl glycol, trimethylol ethane, 2-methyl-2-propyl-1,3-propanediol, trimethylol propane, pentaerythritol and dipentaerythritol) with alkanoic acids containing at least 4 carbon atoms, preferably $C_5$ to $C_{30}$ acids such as saturated straight chain fatty acids including caprylic acid, capric acid, lauric acid, myristic acid, palmitic acid, stearic acid, arachic acid, and behenic acid, or the corresponding branched chain fatty acids or unsaturated fatty acids such as oleic acid, or mixtures of any of these materials.

Suitable synthetic ester components include the esters of trimethylol propane, trimethylol butane, trimethylol ethane, pentaerythritol and/or dipentaerythritol with one or more monocarboxylic acids containing from 5 to 10 carbon atoms. These esters are widely available commercially, for example, the Mobil P-41 and P-51 esters of ExxonMobil Chemical Company.

Also useful are esters derived from renewable material such as coconut, palm, rapeseed, soy, sunflower and the like. These esters may be monoesters, di-esters, polyol esters, complex esters, or mixtures thereof. These esters are widely available commercially, for example, the Mobil P-51 ester of ExxonMobil Chemical Company.

Engine oil formulations containing renewable esters are included in this disclosure. For such formulations, the renewable content of the ester is typically greater than 70 weight percent, preferably more than 80 weight percent and most preferably more than 90 weight percent. Renewable esters can be preferred in combination with the friction modifier mixture.

Other useful fluids of lubricating viscosity include non-conventional or unconventional base stocks that have been processed, preferably catalytically, or synthesized to provide high performance lubrication characteristics.

Non-conventional or unconventional base stocks/base oils include one or more of a mixture of base stock(s) derived from one or more Gas-to-Liquids (GTL) materials, as well as isomerate/isodewaxate base stock(s) derived from natural wax or waxy feeds, mineral and or non-mineral oil waxy feed stocks such as slack waxes, natural waxes, and waxy stocks such as gas oils, waxy fuels hydrocracker bottoms, waxy raffinate, hydrocrackate, thermal crackates, or other mineral, mineral oil, or even non-petroleum oil derived waxy materials such as waxy materials received from coal liquefaction or shale oil, and mixtures of such base stocks.

GTL materials are materials that are derived via one or more synthesis, combination, transformation, rearrangement, and/or degradation/deconstructive processes from gaseous carbon-containing compounds, hydrogen-containing compounds and/or elements as feed stocks such as hydrogen, carbon dioxide, carbon monoxide, water, methane, ethane, ethylene, acetylene, propane, propylene, propyne, butane, butylenes, and butynes. GTL base stocks and/or base oils are GTL materials of lubricating viscosity that are generally derived from hydrocarbons; for example, waxy synthesized hydrocarbons, that are themselves derived from simpler gaseous carbon-containing compounds, hydrogen-containing compounds and/or elements as feed stocks. GTL base stock(s) and/or base oil(s) include oils boiling in the lube oil boiling range (1) separated/fractionated from synthesized GTL materials such as, for example, by distillation and subsequently subjected to a final wax processing step which involves either or both of a catalytic dewaxing process, or a solvent dewaxing process, to produce lube oils of reduced/low pour point; (2) synthesized wax isomerates, comprising, for example, hydrodewaxed or hydroisomerized cat and/or solvent dewaxed synthesized wax or waxy hydrocarbons; (3) hydrodewaxed or hydroisomerized cat and/or solvent dewaxed Fischer-Tropsch (F-T) material (i.e., hydrocarbons, waxy hydrocarbons, waxes and possible analogous oxygenates); preferably hydrodewaxed or hydroisomerized/followed by cat and/or solvent dewaxing dewaxed F-T waxy hydrocarbons, or hydrodewaxed or hydroisomerized/followed by cat (or solvent) dewaxing dewaxed, F-T waxes, or mixtures thereof.

GTL base stock(s) and/or base oil(s) derived from GTL materials, especially, hydrodewaxed or hydroisomerized/followed by cat and/or solvent dewaxed wax or waxy feed, preferably F-T material derived base stock(s) and/or base oil(s), are characterized typically as having kinematic viscosities at 100° C. of from 2 $mm^2/s$ to 50 $mm^2/s$ (ASTM D445). They are further characterized typically as having pour points of −5° C. to −40° C. or lower (ASTM D97). They are also characterized typically as having viscosity indices of 80 to 140 or greater (ASTM D2270).

In addition, the GTL base stock(s) and/or base oil(s) are typically highly paraffinic (>90% saturates), and may contain mixtures of monocycloparaffins and multicycloparaffins in combination with non-cyclic isoparaffins. The ratio of the naphthenic (i.e., cycloparaffin) content in such combinations varies with the catalyst and temperature used. Further, GTL base stock(s) and/or base oil(s) typically have very low sulfur and nitrogen content, generally containing less than 10 ppm, and more typically less than 5 ppm of each of these elements. The sulfur and nitrogen content of GTL base stock(s) and/or base oil(s) obtained from F-T material, especially F-T wax, is essentially nil. In addition, the absence of phosphorous and aromatics make this materially especially suitable for the formulation of low SAP products.

The term GTL base stock and/or base oil and/or wax isomerate base stock and/or base oil is to be understood as embracing individual fractions of such materials of wide viscosity range as recovered in the production process, mixtures of two or more of such fractions, as well as mixtures of one or two or more low viscosity fractions with one, two or more higher viscosity fractions to produce a blend wherein the blend exhibits a target kinematic viscosity.

The GTL material, from which the GTL base stock(s) and/or base oil(s) is/are derived is preferably an F-T material (i.e., hydrocarbons, waxy hydrocarbons, wax).

In addition, the GTL base stock(s) and/or base oil(s) are typically highly paraffinic (>90% saturates), and may contain mixtures of monocycloparaffins and multicycloparaffins in combination with non-cyclic isoparaffins. The ratio of the naphthenic (i.e., cycloparaffin) content in such combinations varies with the catalyst and temperature used. Further, GTL base stock(s) and/or base oil(s) and hydrodewaxed, or hydroisomerized/cat (and/or solvent) dewaxed base stock(s) and/or base oil(s) typically have very low sulfur and nitrogen content, generally containing less than 10 ppm, and more typically less than 5 ppm of each of these elements. The sulfur and nitrogen content of GTL base stock(s) and/or base oil(s) obtained from F-T material, especially F-T wax, is essentially nil. In addition, the absence of phosphorous and aromatics make this material especially suitable for the formulation of low sulfur, sulfated ash, and phosphorus (low SAP) products.

Base oils for use in the formulated lubricating oils useful in the present disclosure are any of the variety of oils corresponding to API Group I, Group II, Group III, Group IV, and Group V oils and mixtures thereof, preferably API Group II, Group III, Group IV, and Group V oils and mixtures thereof, more preferably the Group III to Group V base oils due to their exceptional volatility, stability, viscometric and cleanliness features. Minor quantities of Group I stock, such as the amount used to dilute additives for blending into formulated lube oil products, can be tolerated but should be kept to a minimum, i.e. amounts only associated with their use as diluent/carrier oil for additives used on an "as-received" basis. Even in regard to the Group II stocks, it is preferred that the Group II stock be in the higher quality range associated with that stock, i.e. a Group II stock having a viscosity index in the range 100<VI<120.

The lubricating base oil or base stock constitutes the major component of the engine oil lubricant composition of the present disclosure. One particularly preferred lubricating oil base stock for the inventive lubricating engine oil and the inventive method for improving fuel efficiency, frictional properties and deposit control is a Group I base stock that is included in the formulated oil at from 75 to 95 wt %, or from 80 to 90 wt %, or from 82 to 88 wt %. Another particularly preferred lubricating oil base stock for the inventive lubricating engine oil and the inventive method for improving fuel efficiency, frictional properties and deposit control is a combination of a Group III, Group IV and Group V base stock wherein the combination is included in the formulated oil at from 75 to 95 wt %, or from 80 to 90 wt %, or from 82 to 88 wt %. In this form, the Group III base stock is included at from 30 to 35 wt % or from 32 to 33 wt %, the Group IV base stock at from 45 to 55 wt % or from 48 to 52 wt %, and the Group V base stock at from 0 to 5 wt %, or from 2 to 4 wt %.

Preferred Group III base stocks are GTL and Yubase Plus (hydroprocessed base stock). Preferred Group V base stocks include alkylated naphthalene, synthetic esters and combinations thereof.

The inventive base oils or base stocks described above have a kinematic viscosity, according to ASTM standards, of 2.5 cSt to 12 cSt (or $mm^2/s$) at 100° C., preferably of 2.5 cSt to 9 cSt (or $mm^2/s$) at 100° C., more preferably of 4 cSt to 8 cSt (or $mm^2/s$) at 100° C., and even more preferably of 4 cSt to 6 cSt (or $mm^2/s$) at 100° C.

Friction Modifier Mixtures

Friction modifier mixtures useful in this disclosure are any materials that can alter the coefficient of friction of a surface lubricated by any lubricant or fluid containing such material(s). Mixtures of friction modifiers, also known as friction reducers, or lubricity agents or oiliness agents, and other such agents that change the ability of base oils, formulated lubricant compositions, or functional fluids, to modify the coefficient of friction of a lubricated surface can be effectively used in combination with the base oils or lubricant compositions of the present disclosure. Friction modifier mixtures that lower the coefficient of friction are particularly advantageous in combination with the base oils and lube compositions of this disclosure.

Illustrative friction modifier mixtures useful in the lubricating engine oil formulations of this disclosure include, for example, a first friction modifier, and at least one other friction modifier different from said first friction modifier. The first friction modifier and the at least one other friction modifier are selected from the group consisting of an alkoxylated fatty acid ester, and a polyol fatty acid ester.

Illustrative alkoxylated fatty acid esters include, for example, polyoxyethylene stearate, fatty acid polyglycol ester, and the like. These can include polyoxypropylene stearate, polyoxybutylene stearate, polyoxyethylene isostearate, polyoxypropylene isostearate, polyoxyethylene palmitate.

Illustrative polyol fatty acid esters include, for example, glycerol mono-oleate, saturated mono-, di, and tri-glyceride esters, glycerol mono-stearate, and the like. These can include polyol esters and hydroxyl-containing polyol esters. In addition to glycerol polyols, these can include trimethylolpropane, pentaerythritol, sorbitan, and the like. These esters can be polyol monocarboxylate esters, polyol dicarboxylate esters, and on occasion polyoltricarboxylate esters. Preferred can be the glycerol mono-oleates, glycerol dioleates, glycerol trioleates, glycerol monostearates, glycerol distearates, and glycerol tristearates and the corresponding glycerol monopalmitates, glycerol dipalmitates, and glycerol tripalmitates, and the respective isostearates, linoleates, and the like. On occasion the glycerol esters can be preferred as well as mixtures containing any of these. Ethoxylated, propoxylated, butoxylated fatty acid esters of polyols, especially using glycerol as underlying polyol can be preferred.

Useful concentrations of friction modifier mixtures may range from 0.01 weight percent to 10-15 weight percent or more, often with a preferred range of 0.1 weight percent to 5 weight percent, or 0.1 weight percent to 2.5 weight percent, or 0.1 weight percent to 1.5 weight percent, or 0.1 weight percent to 1 weight percent. The weight ratio of the first friction modifier to the other friction modifier can range from 0.1:1 to 1:0.1.

A preferred friction modifier mixture of this disclosure comprises a polymeric ethoxylated fatty acid ester and a mixed glyceride ester (mono-, di-, and tri-glyceride). The polymeric ethoxylated fatty acid ester friction modifier is included in the formulated oil at from 0.1 to 1.0 wt %, or 0.2 to 0.9 wt %, or 0.3 to 0.8 wt %, or 0.4 to 0.7 wt %. The mixed glyceride ester friction modifier is included in the formulated oil at from 0.1 to 1.0 wt %, or 0.2 to 0.9 wt %, or 0.3 to 0.8 wt %, or 0.4 to 0.7 wt %. The polymeric ethoxylated fatty acid ester friction modifier may have a molecular weight of greater than or equal to 1000, or 2000, or 3000, or 4000, or 5000. One preferred form of the mixed glyceride ester friction modifier includes about 43 wt % $C_{16}$ saturated acid and about 54 wt % $C_{18}$ saturated acid and has a molecular weight of about 330.

Other Additives

The formulated lubricating oil useful in the present disclosure may additionally contain one or more of the other commonly used lubricating oil performance additives including but not limited to antiwear agents, dispersants, other detergents, corrosion inhibitors, rust inhibitors, metal deactivators, extreme pressure additives, anti-seizure agents, wax modifiers, viscosity index improvers, viscosity modifiers, fluid-loss additives, seal compatibility agents, organic metallic friction modifiers, lubricity agents, anti-staining agents, chromophoric agents, defoamants, demulsifiers, emulsifiers, densifiers, wetting agents, gelling agents, tackiness agents, colorants, and others. For a review of many commonly used additives, see Klamann in Lubricants and Related Products, Verlag Chemie, Deerfield Beach, Fla.; ISBN 0-89573-177-0. Reference is also made to "Lubricant Additives" by M. W. Ranney, published by Noyes Data Corporation of Parkridge, N J (1973); see also U.S. Pat. No. 7,704,930, the disclosure of which is incorporated herein in its entirety. These additives are commonly delivered with varying amounts of diluent oil that may range from 5 weight percent to 50 weight percent.

The types and quantities of performance additives used in combination with the instant disclosure in lubricant compositions are not limited by the examples shown herein as illustrations.

Antiwear Additive

A metal alkylthiophosphate and more particularly a metal dialkyl dithio phosphate in which the metal constituent is zinc, or zinc dialkyl dithio phosphate (ZDDP) is a useful component of the lubricating oils of this disclosure. ZDDP can be derived from primary alcohols, secondary alcohols or mixtures thereof. ZDDP compounds generally are of the formula $Zn[SP(S)(OR^1)(OR^2)]_2$ where $R^1$ and $R^2$ are $C_1$-$C_{18}$ alkyl groups, preferably $C_2$-$C_{12}$ alkyl groups. These alkyl groups may be straight chain or branched. Alcohols used in the ZDDP can be 2-propanol, butanol, secondary butanol, pentanols, hexanols such as 4-methyl-2-pentanol, n-hexanol, n-octanol, 2-ethyl hexanol, alkylated phenols, and the like. Mixtures of secondary alcohols or of primary and secondary alcohol can be preferred. Alkyl aryl groups may also be used.

Preferable zinc dithiophosphates which are commercially available include secondary zinc dithiophosphates such as those available from for example, The Lubrizol Corporation under the trade designations "LZ 677A", "LZ 1095" and "LZ 1371", from for example Chevron Oronite under the trade designation "OLOA 262" and from for example Afton Chemical under the trade designation "HITEC 7169".

The ZDDP is typically used in amounts of from 0.4 weight percent to 1.2 weight percent, preferably from 0.5 weight percent to 1.0 weight percent, and more preferably from 0.6 weight percent to 0.8 weight percent, based on the total weight of the lubricating oil, although more or less can often be used advantageously. Preferably, the ZDDP is a secondary ZDDP and present in an amount of from 0.6 to 1.0 weight percent of the total weight of the lubricating oil.

Low phosphorus engine oil formulations are included in this disclosure. For such formulations, the phosphorus content is typically less than 0.12 weight percent preferably less than 0.10 weight percent and most preferably less than 0.085 weight percent. Low phosphorus can be preferred in combination with the friction modifier mixture.

Viscosity Index Improvers

Viscosity index improvers (also known as VI improvers, viscosity modifiers, and viscosity improvers) can be included in the lubricant compositions of this disclosure.

Viscosity index improvers provide lubricants with high and low temperature operability. These additives impart shear stability at elevated temperatures and acceptable viscosity at low temperatures.

Suitable viscosity index improvers include high molecular weight hydrocarbons, polyesters and viscosity index improver dispersants that function as both a viscosity index improver and a dispersant. Typical molecular weights of these polymers are between 10,000 to 1,500,000, more typically 20,000 to 1,200,000, and even more typically between 50,000 and 1,000,000.

Examples of suitable viscosity index improvers are linear or star-shaped polymers and copolymers of methacrylate, butadiene, olefins, or alkylated styrenes. Polyisobutylene is a commonly used viscosity index improver. Another suitable viscosity index improver is polymethacrylate (copolymers of various chain length alkyl methacrylates, for example), some formulations of which also serve as pour point depressants. Other suitable viscosity index improvers include copolymers of ethylene and propylene, hydrogenated block copolymers of styrene and isoprene, and polyacrylates (copolymers of various chain length acrylates, for example). Specific examples include styrene-isoprene or styrene-butadiene based polymers of 50,000 to 200,000 molecular weight.

Olefin copolymers, are commercially available from Chevron Oronite Company LLC under the trade designation "PARATONE®" (such as "PARATONE® 8921" and "PARATONE® 8941"); from Afton Chemical Corporation under the trade designation "HiTEC®" (such as "HiTEC® 5850B"; and from The Lubrizol Corporation under the trade designation "Lubrizol® 7067C". Polyisoprene polymers are commercially available from Infineum International Limited, e.g. under the trade designation "SV200"; diene-styrene copolymers are commercially available from Infineum International Limited, e.g. under the trade designation "SV 260".

In an embodiment of this disclosure, the viscosity index improvers may be used in an amount of less than 2.0 weight percent, preferably less than 1.0 weight percent, and more preferably less than 0.5 weight percent, based on the total weight of the formulated oil or lubricating engine oil. Viscosity improvers are typically added as concentrates, in large amounts of diluent oil.

In another embodiment of this disclosure, the viscosity index improvers may be used in an amount of from 0.25 to 2.0 weight percent, preferably 0.15 to 1.0 weight percent, and more preferably 0.05 to 0.5 weight percent, based on the total weight of the formulated oil or lubricating engine oil.

Detergents

Illustrative detergents useful in this disclosure include, for example, alkali metal detergents, alkaline earth metal detergents, or mixtures of one or more alkali metal detergents and one or more alkaline earth metal detergents. A typical detergent is an anionic material that contains a long chain hydrophobic portion of the molecule and a smaller anionic or oleophobic hydrophilic portion of the molecule. The anionic portion of the detergent is typically derived from an organic acid such as a sulfur acid, carboxylic acid, phosphorous acid, phenol, or mixtures thereof. The counterion is typically an alkaline earth or alkali metal.

Salts that contain a substantially stochiometric amount of the metal are described as neutral salts and have a total base number (TBN, as measured by ASTM D2896) of from 0 to 80. Many compositions are overbased, containing large amounts of a metal base that is achieved by reacting an excess of a metal compound (a metal hydroxide or oxide, for example) with an acidic gas (such as carbon dioxide). Useful detergents can be neutral, mildly overbased, or highly overbased. These detergents can be used in mixtures of neutral, overbased, highly overbased calcium salicylate, sulfonates, phenates and/or magnesium salicylate, sulfonates, phenates. The TBN ranges can vary from low, medium to high TBN products, including as low as 0 to as high as 600. Mixtures of low, medium, high TBN can be used, along with mixtures of calcium and magnesium metal based detergents, and including sulfonates, phenates, salicylates, and carboxylates. A detergent mixture with a metal ratio of 1, in conjunction of a detergent with a metal ratio of 2, and as high as a detergent with a metal ratio of 5, can be used. Borated detergents can also be used.

Alkaline earth phenates are another useful class of detergent. These detergents can be made by reacting alkaline earth metal hydroxide or oxide ($CaO$, $Ca(OH)_2$, $BaO$, $Ba(OH)_2$, $MgO$, $Mg(OH)_2$, for example) with an alkyl phenol or sulfurized alkylphenol. Useful alkyl groups include straight chain or branched $C_1$-$C_{30}$ alkyl groups, preferably, $C_4$-$C_{20}$ or mixtures thereof. Examples of suitable phenols include isobutylphenol, 2-ethylhexylphenol, nonylphenol, dodecyl phenol, and the like. It should be noted that starting alkylphenols may contain more than one alkyl substituent that are each independently straight chain or branched and can be used from 0.5 to 6 weight percent.

When a non-sulfurized alkylphenol is used, the sulfurized product may be obtained by methods well known in the art. These methods include heating a mixture of alkylphenol and sulfurizing agent (including elemental sulfur, sulfur halides such as sulfur dichloride, and the like) and then reacting the sulfurized phenol with an alkaline earth metal base.

Metal salts of carboxylic acids are also useful as detergents. These carboxylic acid detergents may be prepared by reacting a basic metal compound with at least one carboxylic acid and removing free water from the reaction product. These compounds may be overbased to produce the desired TBN level. Detergents made from salicylic acid are one preferred class of detergents derived from carboxylic acids. Useful salicylates include long chain alkyl salicylates. One useful family of compositions is of the formula

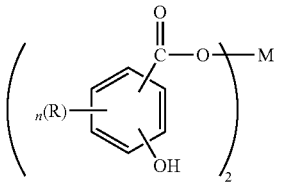

where R is an alkyl group having 1 to 30 carbon atoms, n is an integer from 1 to 4, and M is an alkaline earth metal. Preferred R groups are alkyl chains of at least $C_{11}$, preferably $C_{13}$ or greater. R may be optionally substituted with substituents that do not interfere with the detergent's function. M is preferably, calcium, magnesium, or barium. More preferably, M is calcium.

Hydrocarbyl-substituted salicylic acids may be prepared from phenols by the Kolbe reaction (see U.S. Pat. No. 3,595,791). The metal salts of the hydrocarbyl-substituted salicylic acids may be prepared by double decomposition of a metal salt in a polar solvent such as water or alcohol.

Alkaline earth metal phosphates are also used as detergents and are known in the art.

Detergents may be simple detergents or what is known as hybrid or complex detergents. The latter detergents can provide the properties of two detergents without the need to blend separate materials. See U.S. Pat. No. 6,034,039.

Preferred detergents include calcium phenates, calcium sulfonates, calcium salicylates, magnesium phenates, magnesium sulfonates, magnesium salicylates and other related components (including borated detergents), and mixtures thereof. Preferred mixtures of detergents include magnesium sulfonate and calcium salicylate, magnesium sulfonate and calcium sulfonate, magnesium sulfonate and calcium phenate, calcium phenate and calcium salicylate, calcium phenate and calcium sulfonate, calcium phenate and magnesium salicylate, calcium phenate and magnesium phenate.

The detergent concentration in the lubricating oils of this disclosure can range from 1.0 to 6.0 weight percent, preferably 2.0 to 5.0 weight percent, and more preferably from 2.0 weight percent to 4.0 weight percent, based on the total weight of the lubricating oil.

One particularly preferred detergent mixture for the inventive lubricating engine oil and the inventive method for improving fuel efficiency, frictional properties and deposit control is a combination of an overbased calcium salicylate detergent and a magnesium sulfonate or a calcium sulfonate detergent. The overbased calcium salicylate detergent may be included in the formulated oil at from 0.5 to 2.5 wt %, or 1.0 to 2.0 wt %, or 1.2 to 1.8 wt %. The magnesium sulfonate or a calcium sulfonate detergent may also be included in the formulated oil at from 0.5 to 2.5 wt %, or 1.0 to 2.0 wt %, or 1.2 to 1.8 wt %.

As used herein, the detergent concentrations are given on an "as delivered" basis. Typically, the active detergent is delivered with a process oil. The "as delivered" detergent typically contains from 20 weight percent to 80 weight percent, or from 40 weight percent to 60 weight percent, of active detergent in the "as delivered" detergent product.

Dispersants

During engine operation, oil-insoluble oxidation byproducts are produced. Dispersants help keep these byproducts in solution, thus diminishing their deposition on metal surfaces. Dispersants used in the formulation of the lubricating oil may be ashless or ash-forming in nature. Preferably, the dispersant is ashless. So-called ashless dispersants are organic materials that form substantially no ash upon combustion. For example, non-metal-containing or borated metal-free dispersants are considered ashless. In contrast, metal-containing detergents discussed above form ash upon combustion.

Suitable dispersants typically contain a polar group attached to a relatively high molecular weight hydrocarbon chain. The polar group typically contains at least one element of nitrogen, oxygen, or phosphorus. Typical hydrocarbon chains contain 50 to 400 carbon atoms.

A particularly useful class of dispersants are the alkenylsuccinic derivatives, typically produced by the reaction of a long chain hydrocarbyl substituted succinic compound, usually a hydrocarbyl substituted succinic anhydride, with a polyhydroxy or polyamino compound. The long chain hydrocarbyl group constituting the oleophilic portion of the molecule which confers solubility in the oil, is normally a polyisobutylene group. Many examples of this type of dispersant are well known commercially and in the literature. Exemplary U.S. patents describing such dispersants are U.S. Pat. Nos. 3,172,892; 3,215,707; 3,219,666; 3,316,177; 3,341,542; 3,444,170; 3,454,607; 3,541,012; 3,630,904; 3,632,511; 3,787,374 and 4,234,435. Other types of dispersant are described in U.S. Pat. Nos. 3,036,003; 3,200,107; 3,254,025; 3,275,554; 3,438,757; 3,454,555; 3,565,804; 3,413,347; 3,697,574; 3,725,277; 3,725,480; 3,726,882; 4,454,059; 3,329,658; 3,449,250; 3,519,565; 3,666,730; 3,687,849; 3,702,300; 4,100,082; 5,705,458. A further description of dispersants may be found, for example, in European Patent Application No. 471 071, to which reference is made for this purpose.

Hydrocarbyl-substituted succinic acid and hydrocarbyl-substituted succinic anhydride derivatives are useful dispersants. In particular, succinimide, succinate esters, or succinate ester amides prepared by the reaction of a hydrocarbon-substituted succinic acid compound preferably having at least 50 carbon atoms in the hydrocarbon substituent, with at least one equivalent of an alkylene amine are particularly useful, although on occasion, having a hydrocarbon substituent between 20-50 carbon atoms can be useful.

Succinimides are formed by the condensation reaction between hydrocarbyl substituted succinic anhydrides and amines. Molar ratios can vary depending on the polyamine. For example, the molar ratio of hydrocarbyl substituted succinic anhydride to TEPA can vary from 1:1 to 5:1. Representative examples are shown in U.S. Pat. Nos. 3,087,936; 3,172,892; 3,219,666; 3,272,746; 3,322,670; and U.S. Pat. Nos. 3,652,616, 3,948,800; and Canada Patent No. 1,094,044.

Succinate esters are formed by the condensation reaction between hydrocarbyl substituted succinic anhydrides and alcohols or polyols. Molar ratios can vary depending on the alcohol or polyol used. For example, the condensation product of a hydrocarbyl substituted succinic anhydride and pentaerythritol is a useful dispersant.

Succinate ester amides are formed by condensation reaction between hydrocarbyl substituted succinic anhydrides and alkanol amines. For example, suitable alkanol amines include ethoxylated polyalkylpolyamines, propoxylated polyalkylpolyamines and polyalkenylpolyamines such as polyethylene polyamines. One example is propoxylated hexamethylenediamine. Representative examples are shown in U.S. Pat. No. 4,426,305.

The molecular weight of the hydrocarbyl substituted succinic anhydrides used in the preceding paragraphs will typically range between 800 and 2,500 or more. The above products can be post-reacted with various reagents such as sulfur, oxygen, formaldehyde, carboxylic acids such as oleic acid. The above products can also be post reacted with boron compounds such as boric acid, borate esters or highly borated dispersants, to form borated dispersants generally having from 0.1 to 5 moles of boron per mole of dispersant reaction product.

Mannich base dispersants are made from the reaction of alkylphenols, formaldehyde, and amines. See U.S. Pat. No. 4,767,551, which is incorporated herein by reference. Process aids and catalysts, such as oleic acid and sulfonic acids, can also be part of the reaction mixture. Molecular weights of the alkylphenols range from 800 to 2,500. Representative examples are shown in U.S. Pat. Nos. 3,697,574; 3,703,536; 3,704,308; 3,751,365; 3,756,953; 3,798,165; and 3,803,039.

Typical high molecular weight aliphatic acid modified Mannich condensation products useful in this disclosure can be prepared from high molecular weight alkyl-substituted hydroxyaromatics or $HNR_2$ group-containing reactants.

Hydrocarbyl substituted amine ashless dispersant additives are well known to one skilled in the art; see, for example, U.S. Pat. Nos. 3,275,554; 3,438,757; 3,565,804; 3,755,433, 3,822,209, and 5,084,197.

Preferred dispersants include borated and non-borated succinimides, including those derivatives from mono-succinimides, bis-succinimides, and/or mixtures of mono- and bis-succinimides, wherein the hydrocarbyl succinimide is derived from a hydrocarbylene group such as polyisobutylene having a Mn of from 500 to 5000, or from 1000 to 3000, or 1000 to 2000, or a mixture of such hydrocarbylene groups, often with high terminal vinylic groups. Other preferred dispersants include succinic acid-esters and amides, alkylphenol-polyamine-coupled Mannich adducts, their capped derivatives, and other related components. Such additives may be used in an amount of 0.1 to 20 weight percent, preferably 0.5 to 8 weight percent, or more preferably 0.5 to 4 weight percent. On an active ingredient basis, such additives may be used in an amount of 0.06 to 14 weight percent, preferably 0.3 to 6 weight percent. The hydrocarbon portion of the dispersant atoms can range from $C_{60}$ to $C_{400}$, or from $C_{70}$ to $C_{300}$, or from $C_{70}$ to $C_{200}$. These dispersants may contain both neutral and basic nitrogen, and mixtures of both. Dispersants can be end-capped by borates and/or cyclic carbonates.

One particularly preferred dispersant for the inventive lubricating engine oil and the inventive method for improving fuel efficiency, frictional properties and deposit control is a non-borated polyisobutenyl bis-succinimide (PIBSA) dispersant. The non-borated PIBSA dispersant may be included in the formulated oil at from 2.0 to 6.0 wt %, or 3.0 to 5.0 wt %, or 3.5 to 4.5 wt %.

As used herein, the dispersant concentrations are given on an "as delivered" basis. Typically, the active dispersant is delivered with a process oil. The "as delivered" dispersant typically contains from 20 weight percent to 80 weight percent, or from 40 weight percent to 60 weight percent, of active dispersant in the "as delivered" dispersant product.

Antioxidants

Antioxidants retard the oxidative degradation of base oils during service. Such degradation may result in deposits on metal surfaces, the presence of sludge, or a viscosity increase in the lubricant. One skilled in the art knows a wide variety of oxidation inhibitors that are useful in lubricating oil compositions. See, Klamann in Lubricants and Related Products, op cite, and U.S. Pat. Nos. 4,798,684 and 5,084,197, for example.

Useful antioxidants include hindered phenols. These phenolic antioxidants may be ashless (metal-free) phenolic compounds or neutral or basic metal salts of certain phenolic compounds. Typical phenolic antioxidant compounds are the hindered phenolics which are the ones which contain a sterically hindered hydroxyl group, and these include those derivatives of dihydroxy aryl compounds in which the hydroxyl groups are in the o- or p-position to each other. Typical phenolic antioxidants include the hindered phenols substituted with $C_6$+ alkyl groups and the alkylene coupled derivatives of these hindered phenols. Examples of phenolic materials of this type 2-t-butyl-4-heptyl phenol; 2-t-butyl-4-octyl phenol; 2-t-butyl-4-dodecyl phenol; 2,6-di-t-butyl-4-heptyl phenol; 2,6-di-t-butyl-4-dodecyl phenol; 2-methyl-6-t-butyl-4-heptyl phenol; and 2-methyl-6-t-butyl-4-dodecyl phenol. Other useful hindered mono-phenolic antioxidants may include for example hindered 2,6-di-alkyl-phenolic proprionic ester derivatives. Bis-phenolic antioxidants may also be advantageously used in combination with the instant disclosure. Examples of ortho-coupled phenols include: 2,2'-bis(4-heptyl-6-t-butyl-phenol); 2,2'-bis(4-octyl-6-t-butyl-phenol); and 2,2'-bis(4-dodecyl-6-t-butyl-phenol). Para-coupled bisphenols include for example 4,4'-bis(2,6-di-t-butyl phenol) and 4,4'-methylene-bis(2,6-di-t-butyl phenol).

Effective amounts of one or more catalytic antioxidants may also be used. The catalytic antioxidants comprise an effective amount of a) one or more oil soluble polymetal organic compounds; and, effective amounts of b) one or more substituted N,N'-diaryl-o-phenylenediamine compounds or c) one or more hindered phenol compounds; or a combination of both b) and c). Catalytic antioxidants are more fully described in U.S. Pat. No. 8,048,833, herein incorporated by reference in its entirety.

Non-phenolic oxidation inhibitors which may be used include aromatic amine antioxidants and these may be used either as such or in combination with phenolics. Typical examples of non-phenolic antioxidants include: alkylated and non-alkylated aromatic amines such as aromatic monoamines of the formula $R^8R^9R^{10}N$ where $R^8$ is an aliphatic, aromatic or substituted aromatic group, $R^9$ is an aromatic or a substituted aromatic group, and $R^{10}$ is H, alkyl, aryl or $R^{11}S(O)_xR^{12}$ where $R^{11}$ is an alkylene, alkenylene, or aralkylene group, $R^{12}$ is a higher alkyl group, or an alkenyl, aryl, or alkaryl group, and x is 0, 1 or 2. The aliphatic group $R^8$ may contain from 1 to 20 carbon atoms, and preferably contains from 6 to 12 carbon atoms. The aliphatic group is a saturated aliphatic group. Preferably, both $R^8$ and $R^9$ are aromatic or substituted aromatic groups, and the aromatic group may be a fused ring aromatic group such as naphthyl.

Aromatic groups $R^8$ and $R^9$ may be joined together with other groups such as S.

Typical aromatic amines antioxidants have alkyl substituent groups of at least 6 carbon atoms. Examples of aliphatic groups include hexyl, heptyl, octyl, nonyl, and decyl. Generally, the aliphatic groups will not contain more than 14 carbon atoms. The general types of amine antioxidants useful in the present compositions include diphenylamines, phenyl naphthylamines, phenothiazines, imidodibenzyls and diphenyl phenylene diamines. Mixtures of two or more aromatic amines are also useful. Polymeric amine antioxidants can also be used. Particular examples of aromatic amine antioxidants useful in the present disclosure include: p,p'-dioctyldiphenylamine; t-octylphenyl-alpha-naphthylamine; phenyl-alphanaphthylamine; and p-octylphenyl-alpha-naphthylamine.

Sulfurized alkyl phenols and alkali or alkaline earth metal salts thereof also are useful antioxidants.

Preferred antioxidants include hindered phenols, arylamines. These antioxidants may be used individually by type or in combination with one another. Such additives may be used in an amount of 0.01 to 5 weight percent, preferably 0.01 to 1.5 weight percent, more preferably zero to less than 1.5 weight percent, more preferably zero to less than 1 weight percent.

Pour Point Depressants (PPDs)

Conventional pour point depressants (also known as lube oil flow improvers) may be added to the compositions of the present disclosure if desired. These pour point depressant may be added to lubricating compositions of the present disclosure to lower the minimum temperature at which the fluid will flow or can be poured. Examples of suitable pour point depressants include polymethacrylates, polyacrylates, polyarylamides, condensation products of haloparaffin waxes and aromatic compounds, vinyl carboxylate polymers, and terpolymers of dialkylfumarates, vinyl esters of fatty acids and allyl vinyl ethers. U.S. Pat. Nos. 1,815,022; 2,015,748; 2,191,498; 2,387,501; 2,655, 479; 2,666,746; 2,721,877; 2,721,878; and 3,250,715 describe useful pour point depressants and/or the preparation thereof. Such additives may be used in an amount of 0.01 to 5 weight percent, preferably 0.01 to 1.5 weight percent.

Seal Compatibility Agents

Seal compatibility agents help to swell elastomeric seals by causing a chemical reaction in the fluid or physical change in the elastomer. Suitable seal compatibility agents for lubricating oils include organic phosphates, alkoxysulfonlanes ($C_{10}$ alcohol, for example), aromatic esters, aromatic hydrocarbons, esters (butylbenzyl phthalate, for example), and polybutenyl succinic anhydride. Such additives may be used in an amount of 0.01 to 3 weight percent, preferably 0.01 to 2 weight percent.

Antifoam Agents

Antifoam agents may advantageously be added to lubricant compositions. These agents retard the formation of stable foams. Silicones and organic polymers are typical antifoam agents. For example, polysiloxanes, such as silicon oil or polydimethyl siloxane, provide antifoam properties. Antifoam agents are commercially available and may be used in conventional minor amounts along with other additives such as demulsifiers; usually the amount of these additives combined is less than 1 weight percent and often less than 0.1 weight percent.

Inhibitors and Antirust Additives

Antirust additives (or corrosion inhibitors) are additives that protect lubricated metal surfaces against chemical attack by water or other contaminants. A wide variety of these are commercially available.

One type of antirust additive is a polar compound that wets the metal surface preferentially, protecting it with a film of oil. Another type of antirust additive absorbs water by incorporating it in a water-in-oil emulsion so that only the oil touches the metal surface. Yet another type of antirust additive chemically adheres to the metal to produce a non-reactive surface. Examples of suitable additives include zinc dithiophosphates, metal phenolates, basic metal sulfonates, fatty acids and amines. Such additives may be used in an amount of 0.01 to 5 weight percent, preferably 0.01 to 1.5 weight percent.

Organic Metallic Friction Modifiers

In addition to the friction modifier mixtures used in the lubricating engine oil formulations of this disclosure, organic metallic friction modifiers may also be used. Organic metallic friction modifiers useful in this disclosure are any materials that can alter the coefficient of friction of a surface lubricated by any lubricant or fluid containing such material(s). Organic metallic friction modifiers, also known as friction reducers, or lubricity agents or oiliness agents, and other such agents that change the ability of base oils, formulated lubricant compositions, or functional fluids, to modify the coefficient of friction of a lubricated surface can be effectively used in combination with the base oils or lubricant compositions of the present disclosure. Organic metallic friction modifiers that lower the coefficient of friction are particularly advantageous in combination with the base oils and lube compositions of this disclosure.

Illustrative organic metallic friction modifiers useful in the lubricating engine oil formulations of this disclosure include, for example, molybdenum amine, molybdenum diamine, an organotungstenate, a molybdenum dithiocarbamate, molybdenum dithiophosphates, molybdenum amine complexes, molybdenum carboxylates, and the like. Similar tungsten based compounds may be preferable. Useful concentrations of the organic metallic friction modifiers may range from 0.01 weight percent to 5 weight percent, or 0.1 weight percent to 2.5 weight percent. Useful concentration of molybdenum can range from 25 to 700 ppm, or more preferably from 50 to 200 ppm.

When lubricating oil compositions contain one or more of the additives discussed above, the additive(s) are blended into the composition in an amount sufficient for it to perform its intended function. Typical amounts of such additives useful in the present disclosure are shown in Table 2 below.

It is noted that many of the additives are shipped from the additive manufacturer as a concentrate, containing one or more additives together, with a certain amount of base oil diluents. Accordingly, the weight amounts in the table below, as well as other amounts mentioned herein, are directed to the amount of active ingredient (that is the non-diluent portion of the ingredient). The weight percent (wt %) indicated below is based on the total weight of the lubricating oil composition.

TABLE 2

Typical Amounts of Other Lubricating Oil Components

| Compound | Approximate wt % (Useful) | Approximate wt % (Preferred) |
|---|---|---|
| Dispersant | 0.1-20 | 0.1-8 |
| Detergent | 0.1-20 | 0.1-8 |
| Friction Modifier | 0.01-5 | 0.01-1.5 |
| Antioxidant | 0.1-5 | 0.1-1.5 |
| Pour Point Depressant (PPD) | 0.0-5 | 0.01-1.5 |
| Anti-foam Agent | 0.001-3 | 0.001-0.15 |
| Viscosity Index Improver (solid polymer basis) | 0.1-2 | 0.1-1 |
| Anti-wear | 0.1-2 | 0.5-1 |
| Inhibitor and Antirust | 0.01-5 | 0.01-1.5 |

The foregoing additives are all commercially available materials. These additives may be added independently but are usually precombined in packages which can be obtained from suppliers of lubricant oil additives. Additive packages with a variety of ingredients, proportions and characteristics are available and selection of the appropriate package will take the requisite use of the ultimate composition into account.

The following non-limiting examples are provided to illustrate the disclosure.

EXAMPLES

The detergents used in the formulations were a petroleum derived calcium sulfonate, a synthetic calcium sulfonate, a neutral calcium salicylate, an overbased calcium salicylate, a mixed calcium salicylate, and a magnesium sulfonate.

The friction modifiers used in the formulations included organic friction modifiers and organic metallic friction modifiers. The organic friction modifiers were an ethoxylated fatty ester having a molecular weight of greater than or equal to 2000, and a mixed glyceride ester (mono, di and tri glyceride), contain approximately 43% $C_{16}$ and 54% $C_{18}$ saturated acids and having an approximate molecular weight of 330. The organic metallic friction modifier were either a molybdenum dithiocarbamate or a molybdenum amine complex that were held a constant level of molybdenum for a majority of the formulations.

The dispersants used in the formulations were a non-borated polyisobutenyl bis-succinimde with molecular weight around 2300-2500 and a borated polyisobutenyl bis-succinimde with molecular weight around 1300. The amount of the borated polyisobutenyl bis-succinimde was constant for all formulations.

The antioxidants used in the formulations were a methylene bridged bis-hindered phenol and a alkylated diphenyl amine.

Bench testing was conducted for formulations of this disclosure. The bench testing included the following: kinematic viscosity (KV) at 100° C. measured by ASTM D445; integrated mini traction machine (MTM) friction at 140° C. measured as described below; and thermo-oxidation engine oil simulation test (TEOST 33C) measured by ASTM D6335. For the formulations identified in FIG. 1, the bench testing also included high temperature high shear (HTHS) viscosity at 150° C. measured by ASTM D4683.

The Mini Traction Machine (MTM) is a fully automated instrument manufactured by PCS Instruments and identified as Model MTM. The test specimens and apparatus configuration are such that realistic pressure, temperature and speed can be attained without requiring very large loads, motors or structures. A small sample of fluid (50 milliliters) is placed in a test cell and the machine automatically runs either through a range of speeds, slide-to-roll ratios, temperatures and loads, or at specifically set temperature, slide-to-roll ratio and speed range to generate information regarding the friction performance of a test fluid without further operator intervention. The working of the MTM is known and familiar to those of skill in the art.

PCMO (passenger car motor oil) formulations were prepared. FIG. 1 provides formulation details in weight percent based on the total weight percent of the formulation. A synthetic oil was used as baseline and contained both organic metallic and organic friction modifiers to allow for comparison of the different chemistries. Additional cleanliness and average integrated MTM Stribeck friction data were also collected on oil containing only organic metallic friction modifier, Comparative Example 3, as well as no friction modifier, Comparative Example 2, to provide a reference. All other components were the same across all three blends with the differences being made up by base oil. FIG. 1 summarizes the three oils considered baseline comparison oils for the 0W-20 oils of this disclosure and their respective TEOST 33C and average integrated friction coefficient from MTM Stribeck measurements at 140° C.

In order to allow for numerical comparison of the MTM Stribeck traces, an integration method (the trapezoidal rule) was employed for each curve individually and an average integrated Stribeck friction coefficient and standard deviation for all 4 traces, run back-to-back, was calculated. The average integrated Stribeck friction coefficient provides a measure of the friction an engine will see during operation (albeit at different ratios to those calculated). The MTM integrated area value listed in this disclosure has been calculated using this method. An average integrated friction value of less than or equal to 0.20 is a desirable result.

Combination of Ethoxylated Fatty Ester and Mixed Glyceride Ester

A MTM Stribeck friction treat rate study was undertaken and the results are shown in FIG. 2, indicating that the lowest MTM friction observed was achieved using only ethoxylated fatty ester (red diamonds) in the formulation. Use of ethoxylated fatty ester as a toptreat (blue diamonds) to the baseline formulation also decreased MTM friction versus the baseline formulations, but not as much as for the blends with only ethoxylated fatty ester. The total deposits formed also increased.

Figure 3:
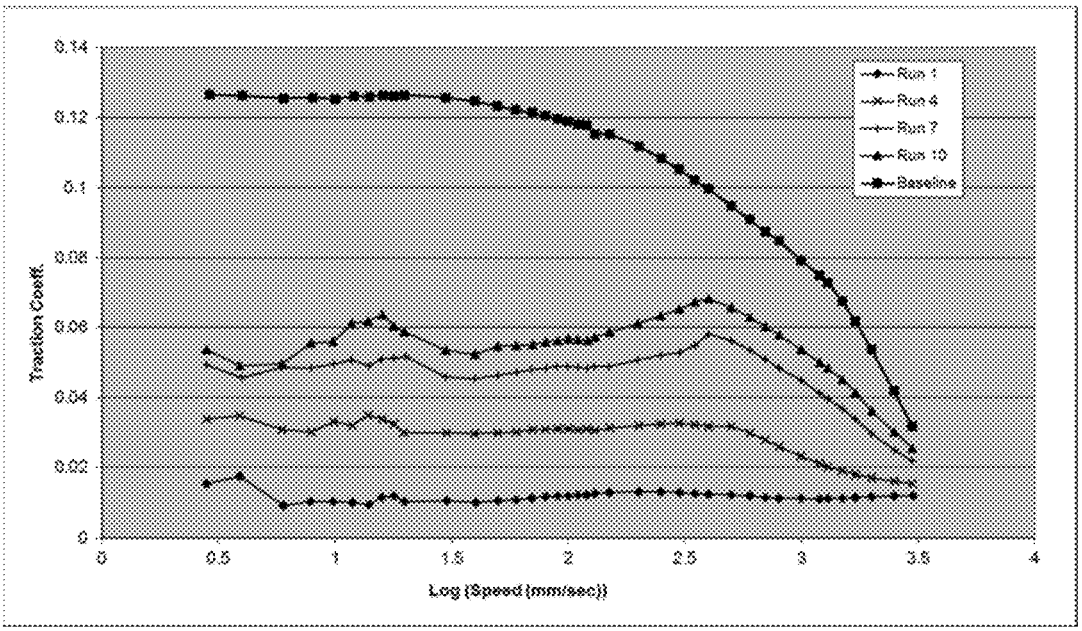
FIG. 3 graphically shows MTM Stribeck friction coefficient plots showing a 0W-20 baseline reference and traces of the same formulation containing only ethoxylated fatty ester as a friction modifier for comparison.

Additionally, to highlight the reduction in friction performance with ethoxylated fatty ester, FIG. 3 shows a comparison of the MTM performance for the baseline oil (Run 4, squares) with mixed glyceride ester and an organic metallic friction modifier versus that of a blend with a 1% treat of ethoxylated fatty ester and no mixed glyceride ester or an organic metallic friction modifier (Run 1, diamonds; Run 4, x; Run 7, +; Run 10 diamonds). Several unexpected performance features are displayed in FIG. 3. First, the average Stribeck friction coefficient for the first four runs (x symbol) is ⅙th of the 0W-20 baseline comparison. Second, the very low first trace indicate that ethoxylated fatty ester is fast-acting. Third, over 10 MTM traces, the ethoxylated fatty ester containing oil continues to build friction, whereas the baseline oil stabilizes after 4-6 traces (not shown), albeit at a significantly higher coefficient of friction. Finally, the ethoxylated fatty ester traces have a defined coefficient of friction structure as a function of speed, confirming the unexpected friction benefits. The addition of ethoxylated fatty ester is clearly shown to have significant friction benefits compared to the baseline with mixed glyceride ester and metal containing organic complex.

Building from the above bench scale work, an engine test oil was developed with 1% ethoxylated fatty ester and an organic metallic friction modifier, but no other friction modifier, and run in the Sequence VID Fuel Economy (ASTM D7589) engine test. The FEI sum for the test oil was 2.9%, an increase over the Sequence VID result for the baseline formulation of 2.6%, showing that the reduced friction seen in the MTM can be translated in an engine test.

While ethoxylated fatty ester has reduced the MTM friction and increased the Sequence VID FEI sum, there is an increase in deposits with ethoxylated fatty ester. FIG. 4 shows the TEOST 33C performance for a number of blends with ethoxylated fatty ester, mixed glyceride ester, or a combination of both. The formulation with only ethoxylated fatty ester, Comparative Example 5, had 43 mg of deposit. TEOST 33C values of greater than 40 mg are unacceptable.

FIG. 4 shows that mixing 0.2% mixed glyceride ester with ethoxylated fatty ester at an unchanged treat, Inventive Example 1, the friction surprising improves, while the TEOST 33C result reduces to 30 mg, can be considered equivalent to Comparative Example 4. The MTM results show that the friction is reduced with the combination of ethoxylated fatty ester and mixed glyceride ester versus the performance of the baseline formulation. Inventive Example 1 thus shows that the use of mixed friction modifier chemistries is unexpectedly used to improve deposits, while maintaining or reducing friction.

The above results show that the combination of ethoxylated fatty ester and mixed glyceride ester can provide improved fuel economy performance by reducing friction with no debit in deposit control.

FIG. 5 shows formulation details in weight percent based on the total weight percent of the formulation, of various formulations. FIG. 5 also shows the results of bench testing of the formulations using thermo-oxidation engine oil simulation test TEOST 33C and MTM friction coefficient. As can be seen in FIG. 5, the concentrations in weight percent of the friction modifiers (ethoxylated fatty ester and mixed glyceride ester) vary from blend to blend while the weight percent of the remaining ingredients remains the same. The results show that formulations with ethoxylated fatty ester and mixed glyceride ester concentrations ranging from 0.1 wt % to 1.0 wt % (while the other is being held constant), exhibit good friction reduction and deposit control properties, as shown in Inventive Example 2 through Inventive Example 18. Additionally, Inventive Example 19 highlights that the use of all-Group I base stock can maintain the good friction performance and low deposits seen with the mixtures of Group II, IV, and V. Comparative Example 6 shows that the base stock selection is important as the expected performance is not seen with all-Group II base stock.

The components and base stocks used in the exemplary formulations of FIG. 6 are set forth therein. All of the ingredients are commercially available.

The detergent used in the formulations was an overbased calcium salicylate, a neutral calcium salicylate, a neutral calcium sulfonate, and a neutral magnesium sulfonate The friction modifiers used in the formulations included organic friction modifiers. The organic friction modifiers were an ethoxylated fatty ester and a mixed glyceride ester. An organic metallic friction modifier (i.e., molybdenum dithiocarbamate) was also used in the formulations.

PIB dispersants, antioxidants, antiwear agents, and pour point depressants were also used in the formulations.

FIG. 6 shows formulation details in weight percent based on the total weight percent of the formulation, of various formulations. FIG. 6 also shows the results of bench testing of the formulations using thermo-oxidation engine oil simulation test (TEOST 33C) measured by ASTM D6335 and MTM friction. As can be seen in FIG. 6, the concentrations in weight percent of multiple additives are varied to show the range of formulations with the claimed performance vary from blend to blend while the weight percent of the remaining ingredients remains the same. Inventive Examples 20 to 25 show that the PIB dispersant can be varied from 2.0 wt % to 5.0 wt % while the overbased detergent can concurrently be varied from 0.5 wt % to 2.5 wt %. Inventive Example 26 shows that the non-borated dispersant can be increased to 6.0 wt % while maintaining the claimed performance.

FIG. 7 shows other formulation variables which meet the claimed performance. Inventive Examples 27 and 28 show the use of calcium sulfonate or magnesium sulfonate do not impact the claimed performance at a constant sulfated ash level. Inventive 29 and 30 show that there is no impact with changes in the amount of viscosity modifier (counted under rest of formulation), covering a wide range of SAE viscosity grades. The viscosity modifier is removed for Example 29, producing an SAE 0W-12 formulation, while the increase in VM creates a 5W-30 product in Example 30. Inventive 31 shows that Group V (alkylated naphthalene) is not needed for the claimed performance or can be replaced by another Group V base stock, ester, in Example 32. Inventive Examples 33 and 34 show that the Mo content of the formulation can be varied from 0 ppm to 250 ppm without impact on performance. Inventive Example 36 supports that the claimed performance does not require a particular Group III stock as the performance is very similar to that of Inventive Example 12. Inventive Example 37 shows that the claimed performance is seen down to 350 ppm phosphorous, while Comparative Example 6 shows that 1000 ppm has a detrimental impact on the performance, leading to higher than expected deposits, Also, Comparative Example 7 shows that reducing the sulfated ash to 0.6 wt % by removal of the neutral calcium salicylate has a detrimental impact on deposit control. The reduced deposit control is understood to be a function of the sulfated ash and would be expected regardless of whether the neutral or overbased calcium salicylate were reduced.

The components and base stocks used in the exemplary formulations of FIG. 7 are set forth therein and are the same as in FIG. 6. All of the ingredients are commercially available.

FIG. 8 shows the combination of the mixed glyceride ester friction modifier and the ethoxylated fatty acid friction modifier is especially effective in a New European Drive Cycle (NEDC) vehicle fuel economy test which was run with an Opel Astra. It is important to note that in an NEDC vehicle fuel economy test, the vehicle starts at room temperature and is operated for approximately 20 minutes to measure fuel consumption. During this test cycle, the oil temperature will increase from approximately 25° C. to 95° C. At these low temperatures, friction modifiers are often inactive. Comparative Example 8 shows that there is minimal fuel economy benefit with the mixed glyceride ester, while the combination of the mixed glyceride ester and the ethoxylated fatty acid ester friction modifier was found to provide fuel economy benefits for an SAE 0W-20 oil when used from 0.25% to 0.50% in Inventive Examples 37 and 38. It was surprising and unexpected to obtain a fuel economy benefit for the friction modifier in this low temperature test.

Other Exemplary Formulations

All patents and patent applications, test procedures (such as ASTM methods, UL methods, and the like), and other documents cited herein are fully incorporated by reference to the extent such disclosure is not inconsistent with this disclosure and for all jurisdictions in which such incorporation is permitted.

When numerical lower limits and numerical upper limits are listed herein, ranges from any lower limit to any upper limit are contemplated. While the illustrative embodiments of the disclosure have been described with particularity, it will be understood that various other modifications will be apparent to and can be readily made by those skilled in the art without departing from the spirit and scope of the disclosure. Accordingly, it is not intended that the scope of the claims appended hereto be limited to the examples and descriptions set forth herein but rather that the claims be construed as encompassing all the features of patentable novelty which reside in the present disclosure, including all features which would be treated as equivalents thereof by those skilled in the art to which the disclosure pertains.

The present disclosure has been described above with reference to numerous embodiments and specific examples. Many variations will suggest themselves to those skilled in this art in light of the above detailed description. All such obvious variations are within the full intended scope of the appended claims.

The invention claimed is:

1. A method for improving fuel efficiency and reducing frictional properties, while maintaining or improving deposit control, in an engine lubricated with a lubricating oil by using as the lubricating engine oil a formulated oil, said formulated oil having a composition comprising:

from 75 to 95 wt % of lubricating oil base stock comprising a Group I base stock or a combination of a Group III, Group IV and Group V base stock comprising from 30 to 35 wt % Group III, 45 to 55 wt % Group IV and 0 to 5 wt % Group V;

a friction modifier mixture comprising a polymeric ethoxylated fatty acid ester at from 0.1 to 1.0 wt. % and a mixed glyceride ester at from 0.1 to 1.0 wt. %, wherein the polymeric ethoxylated fatty acid ester has a molecular weight of greater than or equal to 2000, and wherein the remainder of the lubricating engine oil includes one or more other lubricating oil additives;

wherein fuel efficiency and friction reduction properties are improved (mini-traction machine (MTM) in Stribeck mode friction coefficient at 140° C. less than or equal to 0.20) and deposit control is maintained or improved (TEOST 33C total deposits less than or equal to 40 mg) as compared to friction reduction properties and deposit control achieved using a lubricating engine oil not containing the friction modifier mixture.

2. The method of claim 1, wherein the one or more other lubricating oil additives are selected from the group consisting of an anti-wear additive, viscosity index improver, antioxidant, detergent, dispersant, pour point depressant, corrosion inhibitor, metal deactivator, seal compatibility additive, anti-foam agent, inhibitor, anti-rust additive, and organic metallic friction modifier.

3. The method of claim 1, wherein the lubricating engine oil has a kinematic viscosity at 100 deg. C. ranging from 4 to 12 cSt.

4. The method of claim 1, wherein the Group I, Group III, Group IV and Group V base stocks have a kinematic viscosity at 100 deg. C. ranging from 4 to 6 cSt.

5. The method of claim 1, wherein the lubricating engine oil improves the fuel economy of a vehicle as measured by the New European Drive Cycle (NEDC) vehicle fuel economy test by at least 0.40% compared to a lubricating engine oil not containing the friction modifier mixture.

6. The method of claim 1, wherein the one or more other lubricating oil additives comprise a non-borated polyisobutenyl bis-succinimide (PIBSA) dispersant at from 2.0 to 6.0 wt % of the lubricating engine oil.

7. The method of claim 1, wherein the one or more other lubricating oil additives comprise a detergent mixture including an overbased calcium salicylate detergent at from 0.5 to 2.5 wt % of the lubricating engine oil and a magnesium sulfonate or a calcium sulfonate detergent at from 0 to 0.8 wt % of the lubricating engine oil.

8. The method of claim 1, wherein the lubricating engine oil includes elemental phosphorous ranging from 0.035 to 0.076 wt % of the lubricating engine oil.

9. The method of claim 1, wherein the lubricating engine oil includes elemental molybdenum ranging from 0 to 0.025 wt % of the lubricating engine oil.

10. The method of claim 1, wherein the Group V base stock is selected from the group consisting of an alkylated naphthalene, a synthetic ester and combinations thereof.

11. The method of claim 1, wherein the mixed glyceride ester includes about 43 wt % $C_{16}$ saturated acid and about 54 wt % Cis saturated acid and has a molecular weight of about 330.

12. A lubricating engine oil having a composition comprising:

from 75 to 95 wt % of lubricating oil base stock comprising a Group I base stock or a combination of a Group III, Group IV and Group V base stock comprising from 30 to 35 wt % Group III, 45 to 55 wt % Group IV and 0 to 5 wt % Group V;

a friction modifier mixture comprising a polymeric ethoxylated fatty acid ester at from 0.1 to 1.0 wt. % and a mixed glyceride ester at from 0.1 to 1.0 wt. %, wherein the polymeric ethoxylated fatty acid ester has a molecular weight of greater than or equal to 2000, and wherein the remainder of the lubricating engine oil includes one or more other lubricating oil additives;

wherein fuel efficiency and friction reduction properties are improved (mini-traction machine (MTM) in Stribeck mode friction coefficient at 140° C. less than or equal to 0.20) and deposit control is maintained or improved (TEOST 33C total deposits less than or equal to 40 mg) as compared to friction reduction properties and deposit control achieved using a lubricating engine oil not containing the friction modifier mixture.

13. The lubricating engine oil of claim 12, wherein the one or more other lubricating oil additives are selected from the group consisting of an anti-wear additive, viscosity index improver, antioxidant, detergent, dispersant, pour point depressant, corrosion inhibitor, metal deactivator, seal compatibility additive, anti-foam agent, inhibitor, anti-rust additive, and organic metallic friction modifier.

14. The lubricating engine oil of claim 12, wherein the lubricating engine oil has a kinematic viscosity at 100 deg. C. ranging from 4 to 12 cSt.

15. The lubricating engine oil of claim 12, wherein the Group I, Group III, Group IV and Group V base stocks have a kinematic viscosity at 100 deg. C. ranging from 4 to 6 cSt.

16. The lubricating engine oil of claim 12, wherein the lubricating engine oil improves the fuel economy of a vehicle as measured by the New European Drive Cycle (NEDC) vehicle fuel economy test by at least 0.40% compared to a lubricating engine oil not containing the friction modifier mixture.

17. The lubricating engine oil of claim 12, wherein the one or more other lubricating oil additives comprise a non-borated polyisobutenyl bis-succinimide (PIBSA) dispersant at from 2.0 to 6.0 wt % of the lubricating engine oil.

18. The lubricating engine oil of claim 12, wherein the one or more other lubricating oil additives comprise a detergent mixture including an overbased calcium salicylate detergent at from 0.5 to 2.5 wt % of the lubricating engine oil and a magnesium sulfonate or a calcium sulfonate detergent at from 0 to 0.8 wt % of the lubricating engine oil.

19. The lubricating engine oil of claim 12, wherein the lubricating engine oil includes elemental phosphorous ranging from 0.035 to 0.076 wt % of the lubricating engine oil.

20. The lubricating engine oil of claim 12, wherein the lubricating engine oil includes elemental molybdenum ranging from 0 to 0.025 wt % of the lubricating engine oil.

21. The lubricating engine oil of claim 12, wherein the Group V base stock is selected from the group consisting of alkylated naphthalene, a synthetic ester and combinations thereof.

22. The lubricating engine oil of claim 12, wherein the mixed glyceride ester includes about 43 wt % $C_{16}$ saturated acid and about 54 wt % $C_{18}$ saturated acid and has a molecular weight of about 330.

23. The lubricating engine oil of claim 12, wherein the lubricating engine oil is a passenger vehicle engine oil (PVEO).

* * * * *